US008087760B2

(12) United States Patent
Hibi et al.

(10) Patent No.: US 8,087,760 B2
(45) Date of Patent: Jan. 3, 2012

(54) LIQUID EJECTION HEAD AND DRIVING METHOD THEREOF

(75) Inventors: Manabu Hibi, Nagoya (JP); Naoto Iwao, Nagoya (JP); Shin Ishikura, Kirishima (JP)

(73) Assignees: Brother Kogyo Kabushiki Kaisha, Nagoya-shi, Aichi-ken (JP); Kyocera Corporation, Kyoto-shi, Kyoto-fu (JP)

( * ) Notice: Subject to any disclaimer, the term of this patent is extended or adjusted under 35 U.S.C. 154(b) by 993 days.

(21) Appl. No.: 11/855,025

(22) Filed: Sep. 13, 2007

(65) Prior Publication Data

US 2008/0084457 A1 Apr. 10, 2008

(30) Foreign Application Priority Data

Sep. 14, 2006 (JP) ..... 2006-249775

(51) Int. Cl.
*B41J 2/045* (2006.01)

(52) U.S. Cl. ..... 347/68; 347/12

(58) Field of Classification Search ..... None
See application file for complete search history.

(56) References Cited

U.S. PATENT DOCUMENTS

| | | | |
|---|---|---|---|
| 6,695,437 | B2 | 2/2004 | Nakamura et al. |
| 6,846,069 | B2 * | 1/2005 | Ito et al. ..... 347/71 |
| 2005/0110833 | A1 | 5/2005 | Kodama |

FOREIGN PATENT DOCUMENTS

| | | | |
|---|---|---|---|
| EP | 1661704 | A1 | 5/2006 |
| JP | 2003-039673 | A | 2/2003 |

OTHER PUBLICATIONS

European Patent Office, European Search Report for European Patent Appl'n, No. 07017992.4-2304 (counterpart to above-captioned US patent appl'n) mailed Feb. 1, 2008.

* cited by examiner

*Primary Examiner* — Jerry T Rahll
(74) *Attorney, Agent, or Firm* — Baker Botts L.L.P.

(57) ABSTRACT

A liquid ejection head includes a passage unit and an actuator. A nozzle for ejecting liquid and a common liquid chamber are formed in the passage unit. An individual liquid passage formed in the passage unit includes a first passage a pressure chamber, a second passage, and a restricted passage. The first passage communicates between the nozzle and the pressure chamber. The second passage communicates between the pressure chamber and the restricted passage. The restricted passage is smaller than the second passage in the sectional area perpendicular to the flow of the liquid. The actuator can selectively take a first state in which the volume of the pressure chamber is V1 and a second state in which the volume of the pressure chamber is V2 larger than V1. The actuator changes from the first state into the second state and then returns to the first state to eject the liquid from the nozzle. The individual liquid passage is designed so that Tc1 and Tc2 defined by predetermined expressions showing characteristics of the individual liquid passage satisfy a condition that Tc1/Tc2 is substantially not less than 4.7 and not more than 5.5.

8 Claims, 20 Drawing Sheets

LIQUID EJECTION HEAD AND DRIVING METHOD THEREOF

The present application claims priority from Japanese Patent Application No. 2006-249775, which was filed on Sep. 14, 2006, the disclosure of which is herein incorporated by reference in its entirety.

BACKGROUND OF THE INVENTION

1. Field of the Invention

The present invention relates to a liquid ejection head, in particular, adopting a so-called fill-before-fire method for ejecting liquid, and also to a driving method of the head.

2. Description of Related Art

A liquid ejection head typified by an inkjet head adopting an inkjet system has a passage unit on which nozzles are formed for ejecting liquid, as disclosed in Japanese Patent Unexamined Publication No. 2003-39673. In the passage unit of the liquid ejection head, there are formed common liquid chambers for supplying liquid to the nozzles; and individual liquid passages leading from the common liquid chambers to the respective nozzles. A pressure chamber is formed in the middle of each individual liquid passage. An actuator is provided over the pressure chamber to apply pressure to the liquid in the pressure chamber. In controlling the liquid ejection head, the actuator is driven to apply pressure to the liquid in the pressure chamber so that liquid is ejected from the corresponding nozzle.

In a driving method of the actuator, pressure is applied twice to the liquid in the pressure chamber to eject liquid from the nozzle. For example, first, the volume of the pressure chamber is increased to decrease the pressure in the pressure chamber. Next, when a predetermined time has elapsed after the volume of the pressure chamber was increased, the volume of the pressure chamber is restored to the original volume to increase the pressure in the pressure chamber. Thereby, a proper intensity of pressure is applied to the liquid in the pressure chamber at a proper timing to eject liquid from the nozzle.

In the driving method of the actuator, a relation between the timing of restoring the volume of the pressure chamber to increase the pressure of the liquid in the pressure chamber, and the velocity of liquid ejected from the nozzle, is, for example, as shown in FIG. 9. In FIG. 9, the axis of abscissas corresponds to the timing, and the axis of ordinate represents the velocity of ejected liquid. As shown by a curved line 70 in FIG. 9, the liquid velocity to the timing ideally forms a smooth curve being convex upward, on which the timing at which the ejection velocity becomes the maximum is uniquely determined. Driving the actuator to apply a pressure at the timing at which the ejection velocity becomes the maximum, brings about efficient liquid ejection. An ink ejection method in which control is performed so as to apply the second pressure at the timing at which the ejection velocity takes the peak, is called fill-before-fire method.

The reason why such a peak appears on the ejection velocity to the timing of applying pressure, is as follows. When the pressure in the pressure chamber is decreased, a proper oscillation is generated in the individual liquid passage. When a pressure is then applied to the liquid in the pressure chamber, a pressure wave thereby generated is superimposed on the proper oscillation. Therefore, when the timing of applying the second pressure coincides with a peak of the proper oscillation, the velocity of liquid ejected from the nozzle becomes the maximum. On the other hand, when the second pressure is applied at a timing shifted from the peak of the proper oscillation, the liquid velocity decreases from the maximum value. The larger the difference of the timing of applying the second pressure from the timing that brings about the maximum velocity, the lower the velocity of liquid ejected from the nozzle. For the above reason, the curved line as shown in FIG. 9 is obtained.

On the other hand, when liquid is ejected from the nozzle by using the fill-before-fire method, problems may arise that ejection characteristics such as the velocity and quantity of liquid ejected from the nozzle become bad, and the ejection characteristics vary.

SUMMARY OF THE INVENTION

The inventors of the present invention think that the above problems are caused by that the proper oscillation generated when the pressure is decreased includes a proper oscillation that is shown in the form of a smooth curve as the curved line 70 of FIG. 9, and a proper oscillation shorter in period than the proper oscillation shown as the smooth curve.

The above publication proposes that a liquid ejection head is designed in consideration of such a proper oscillation shorter in period. According to the above publication, the proper oscillation shown by the curved line 70 of FIG. 9 is derived from an oscillation system in which the compliance of the actuator and the compliance of the pressure chamber are connected in parallel. On the other hand, the shorter-period proper oscillation not shown by the curved line 70 of FIG. 9 is derived from an oscillation system in which the compliance of the actuator and the compliance of the pressure chamber are connected in series. To reduce the influence of the latter oscillation system on the former oscillation system, the above publication teaches that the period $T_B$ of the latter oscillation system and the period $T_C$ of the former oscillation system should satisfy a condition of $T_B \ll T_C$, more specifically, $T_B < T_C/10$.

Thus, the above publication proposes a range in which the shorter-period proper oscillation is not generated. Conventionally, proposals have been made for liquid ejection heads in ranges in which such a shorter-period proper oscillation is not generated. In some cases, however, designing so that such a proper oscillation is not generated impairs efficient ink ejection, which is a merit of the fill-before-fire method. In addition, a liquid ejection head in which such a shorter-period proper oscillation is not generated can not always be designed. In fact, any prior art including the above publication seems have not dealt with what measure exists to improve ejection characteristics of a liquid ejection head on the assumption that such a shorter-period proper oscillation is generated.

An object of the present invention is to provide a liquid ejection head and a driving method of the head, wherein the head can be driven so that the ejection characteristics are relatively good and liquid is efficiently ejected, even on the assumption that a proper oscillation shorter in period is generated.

According to an aspect of the present invention, a liquid ejection head comprises a passage unit comprising a nozzle from which liquid is ejected, a common liquid chamber, and an individual liquid passage. The individual liquid passage comprises a first passage one end of which is connected to the nozzle, a pressure chamber one end of which is connected to the other end of the first passage, a second passage one end of which is connected to the other end of the pressure chamber, and a restricted passage one end of which is connected to the other end of the second passage and the other end of which is connected to the common liquid chamber. The restricted passage is smaller than the second passage in the area of a section perpendicular to the direction of the flow of the liquid. The head further comprises an actuator that can selectively take a first state in which the volume of the pressure chamber is V1 and a second state in which the volume of the pressure chamber is V2 larger than V1. The actuator changes from the first state into the second state and then returns to the first state to eject the liquid from the nozzle. Tc1 and Tc2 defined by the following Expressions 1 and 2 satisfy a condition that Tc1/Tc2 is substantially not less than 4.7 and not more than 5.5:

$$T_{C1} = 2\pi\sqrt{\left(\frac{M'_n \times M'_r}{M'_n + M'_r}\right) \times (C_a + C_c + C_d + C_s)} \quad \text{[Expression 1]}$$

$$T_{C2} = 2\pi\sqrt{M_{C2} \times C_{C2}} \quad \text{[Expression 2]}$$

where M'n, M'r, Mc2, and Cc2 are defined by the following Expressions 3 to 6, respectively:

$$M'_n = M_n + M_c/2 \quad \text{[Expression 3]}$$

$$M'_r = M_r + M_c/2 \quad \text{[Expression 4]}$$

$$M_{C2} = \frac{M_d \times (M_c \times M_s)}{M_d + M_c + M_s} + M_a \quad \text{[Expression 5]}$$

$$C_{C2} = \frac{C_d \times C_a}{C_d \times C_a} \quad \text{[Expression 6]}$$

where Md, Ms, Ma, Mn, Mr, and Mc represent the inertances of the first passage, the second passage, the actuator, the nozzle, the restricted passage, and the pressure chamber, respectively; and Ca, Cc, Cd, and Cs represent the compliances of the actuator, the pressure chamber, the first passage, and the second passage, respectively.

According to the above aspect, the liquid ejection head is constructed so that Tc1 and Tc2 satisfy the condition that Tc1/Tc2 is substantially not less than 4.7 and not more than 5.5. Thus, as will be understood from the results of the analyses that will be described later, on the assumption that a short-period proper oscillation is generated in the liquid ejection head, by ejecting liquid in accordance with a peak of the short-period proper oscillation, relatively good ejection characteristics can be ensured.

According to another aspect of the present invention, a driving method of a liquid ejection head is provided. The head comprises a passage unit comprising a nozzle from which liquid is ejected, a common liquid chamber, and an individual liquid passage connecting the nozzle and the common liquid chamber with each other; a pressure chamber provided in the individual liquid passage; and an actuator that can selectively take a first state in which the volume of the pressure chamber is V1 and a second state in which the volume of the pressure chamber is V2 larger than V1. The actuator changes from the first state into the second state and then returns to the first state to eject the liquid from the nozzle. The individual liquid passage comprises a first passage one end of which is connected to the nozzle and the other end of which is connected to one end of the pressure chamber, a second passage one end of which is connected to the other end of the pressure chamber, and a restricted passage one end of which is connected to the other end of the second passage and the other end of which is connected to the common liquid chamber. The restricted passage is smaller than the second passage in the area of a section perpendicular to the direction of the flow of the liquid. The method comprises a first step of making the actuator take the first state; a second step of changing the actuator from the first state into the second state after the first step; and a third step of changing the actuator from the second state into the first state after the second step. Tc1 and Tc2 defined by the following Expressions 1 and 2 satisfy a condition that Tc1/Tc2 is substantially not less than 4.7 and not more than 5.5:

$$T_{C1} = 2\pi\sqrt{\left(\frac{M'_n \times M'_r}{M'_n + M'_r}\right) \times (C_a + C_c + C_d + C_s)} \quad \text{[Expression 1]}$$

$$T_{C2} = 2\pi\sqrt{M_{C2} \times C_{C2}} \quad \text{[Expression 2]}$$

where M'n, M'r, Mc2, and Cc2 are defined by the following Expressions 3 to 6, respectively:

$$M'_n = M_n + M_c/2 \quad \text{[Expression 3]}$$

$$M'_r = M_r + M_c/2 \quad \text{[Expression 4]}$$

$$M_{C2} = \frac{M_d \times (M_c \times M_s)}{M_d + M_c + M_s} + M_a \quad \text{[Expression 5]}$$

$$C_{C2} = \frac{C_d \times C_a}{C_d \times C_a} \quad \text{[Expression 6]}$$

where Md, Ms, Ma, Mn, Mr, and Mc represent the inertances of the first passage, the second passage, the actuator, the nozzle, the restricted passage, and the pressure chamber, respectively; and Ca, Cc, Cd, and Cs represent the compliances of the actuator, the pressure chamber, the first passage, and the second passage, respectively. The first to third steps are executed so that a time period Tf from the start of the actuator changing from the first state to the start of the actuator taking the second state in the second step, and a time period Tr from the start of the actuator changing from the second state to the start of the actuator taking the first state in the third step, satisfy a condition that either of Tr/Tc2 and Tf/Tc2 is substantially not less than 0.3 and not more than 1.0.

According to the above aspect, the liquid ejection head is driven under the condition that either of Tr/Tc2 and Tf/Tc2 is substantially not less than 0.3 and not more than 1.0. Thus, as will be understood from the results of the analyses that will be described later, the liquid ejection head can efficiently and stably eject liquid.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter will be described a preferred embodiment of the present invention.

Figure 1:
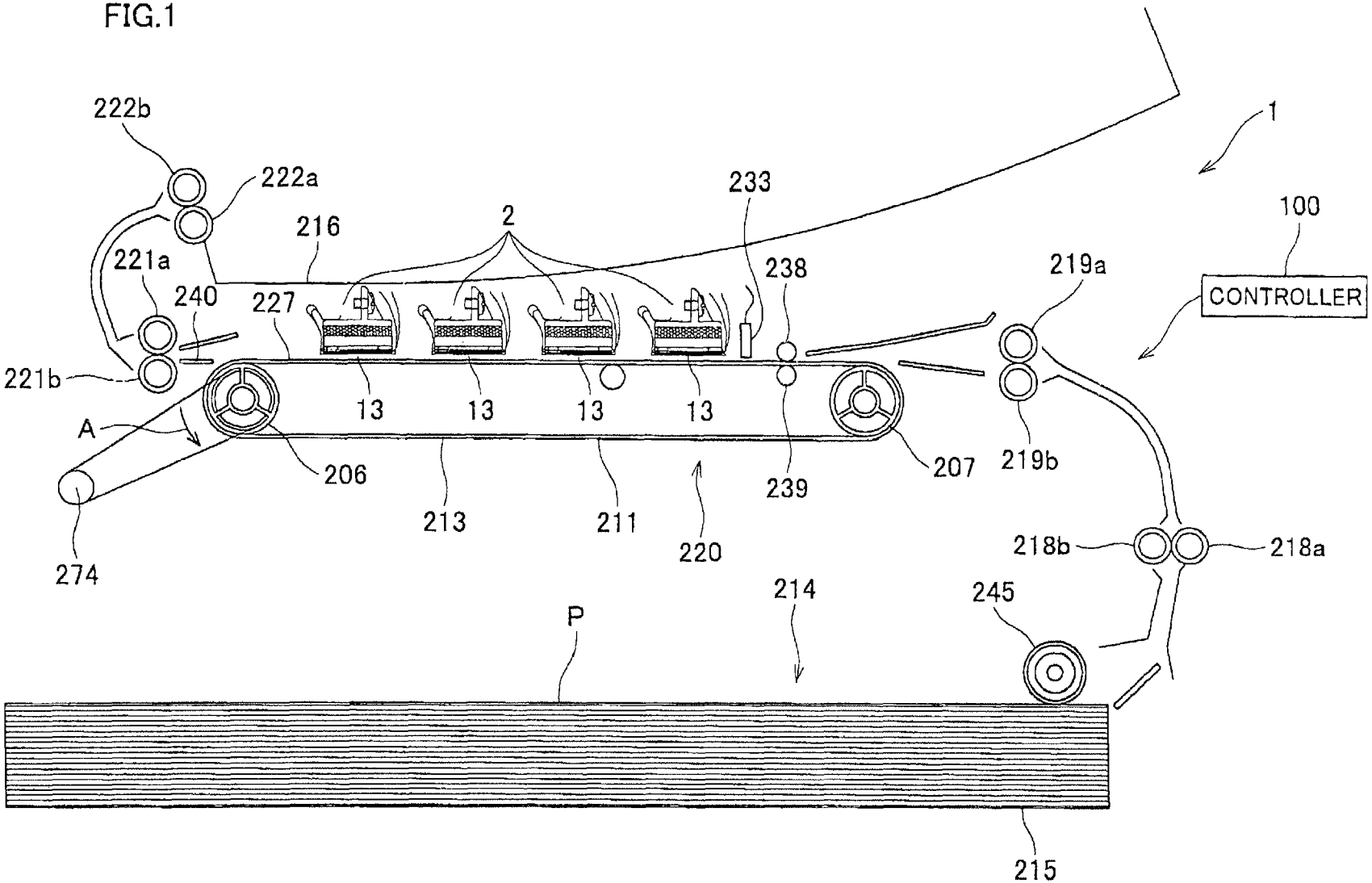
FIG. 1 shows a general construction of a printer as an inkjet recording apparatus according to an embodiment of the present invention.

FIG. 1 shows a general construction of a color inkjet printer according to an embodiment of the present invention. The printer 1 includes therein four inkjet heads 2. The inkjet heads 2 are fixed to the printer 1 in a state of being arranged in the direction of conveyance of printing papers P. Each inkjet head 2 has a slender profile extending perpendicularly to FIG. 1.

The printer 1 includes therein a paper feed unit 214, a conveyance unit 220, and a paper receiving unit 216 provided in this order along the conveyance path for printing papers P. The printer 1 further includes therein a controller 100 that controls the operations of components and units of the printer 1, such as the inkjet heads 2 and the paper feed unit 214.

The paper feed unit 214 includes a paper case 215 and a paper feed roller 245. The paper case 215 can contain a number of printing papers P. The paper feed roller 245 can send out the uppermost one of the printing papers P stacked in the paper case 215, one by one.

Between the paper feed unit 214 and the conveyance unit 220, two pairs of feed rollers 218*a* and 218*b*; and 219*a* and 219*b* are disposed along the conveyance path for printing papers P. Each printing paper P sent out from the paper feed unit 214 is guided by the feed rollers to be sent to the conveyance unit 220.

The conveyance unit 220 includes an endless conveyor belt 211 and two belt rollers 206 and 207. The conveyor belt 211 is wrapped on the belt rollers 206 and 207. The length of the conveyor belt 211 is adjusted so that a predetermined tension can be obtained when the conveyor belt 211 is stretched between the belt rollers. Thus, the conveyor belt 211 is stretched between the belt rollers without slacking, along two planes parallel to each other, each including a common tangent of the belt rollers. Of these two planes, the plane nearer to the inkjet heads 2 includes a conveyance surface 227 of the conveyor belt 211 on which printing papers P are conveyed.

As shown in FIG. 1, one belt roller 206 is connected to a conveyance motor 274. The conveyance motor 274 can rotate the belt roller 206 in the direction of an arrow A. The other belt roller 207 can follow the conveyor belt 211 to rotate. Thus, by driving the conveyance motor 274 to rotate the belt roller 206, the conveyor belt 211 runs in the direction of the arrow A.

Near the belt roller 207, a nip roller 238 and a nip receiving roller 239 are disposed so as to nip the conveyor belt 211. The nip roller 238 is biased downward by a not-shown spring. The nip receiving roller 239 disposed below the nip roller 238 receives the nip roller 238 being biased downward, through the conveyor belt 211. These nip rollers are supported so as to be freely rotatable, and they are rotated by following the conveyor belt 211.

A printing paper P sent out from the paper feed unit 214 to the conveyance unit 220 is nipped between the nip roller 238 and the conveyor belt 211. Thereby, the printing paper P is pressed onto the conveyance surface 227 of the conveyor belt 211, and adheres to the conveyance surface 227. The printing paper P is then conveyed toward the inkjet heads 2 by the running conveyor belt 211. The outer circumferential surface 213 of the conveyor belt 211 may have been treated with adhesive silicone rubber. Thereby, the printing paper P surely adheres to the conveyance surface 227.

Figure 3:
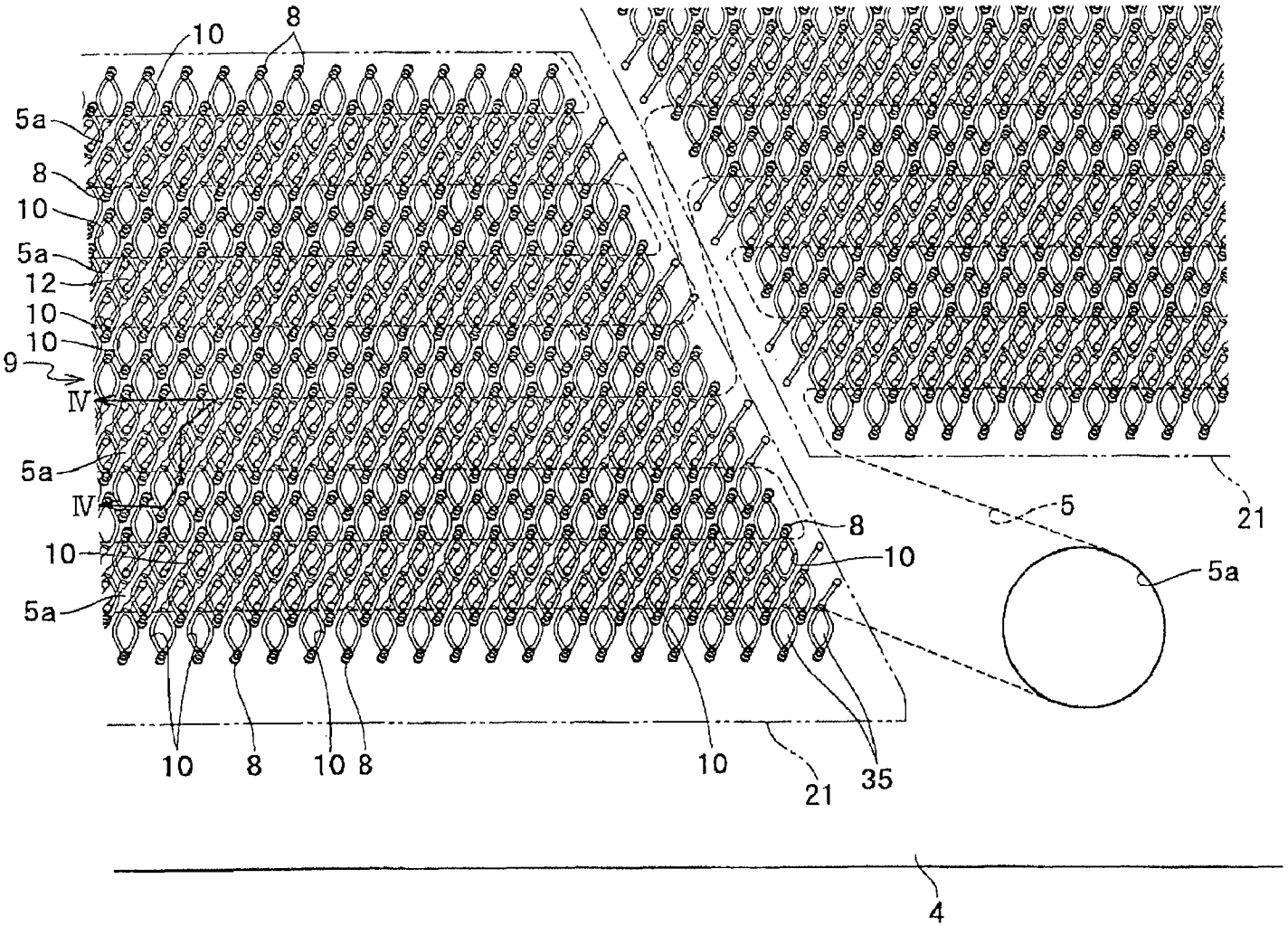
FIG. 3 is an enlarged view of a region enclosed with an alternate long and short dash line in FIG. 2.

Four inkjet heads 2 are arranged close to each other in the direction of conveyance by the conveyor belt 211. Each inkjet head 2 has at its lower end a head main body 13. A large number of nozzles 8 from each of which ink is ejected are formed on the lower face of each head main body 13, as shown in FIG. 3. Ink of the same color is ejected from the nozzles 8 formed on one inkjet head 2. Four inkjet heads 2 eject inks of colors of magenta (M), yellow (Y), cyan (C), and black (K), respectively. Each inkjet head 2 is disposed such that a narrow space is formed between the lower face of the head main body 13 and the conveyance surface 227 of the conveyor belt 211.

Each printing paper P being conveyed by the conveyor belt 211 passes through the space between each inkjet head 2 and the conveyor belt 211. At this time, ink is ejected from the head main body 13 of the inkjet head 2 toward the upper surface of the printing paper P. Thus, a color image based on image data stored in the controller 100 is formed on the upper surface of the printing paper P.

Between the conveyance unit 220 and the paper receiving unit 216, there are provided a peeling plate 240 and two pairs of feed rollers 221*a* and 221*b*; and 222*a* and 222*b*. The printing paper P on which the color image has been printed is conveyed to the peeling plate 240 by the conveyor belt 211. The printing paper P is then peeled off the conveyance surface 227 of the conveyor belt 211 by the right edge of the peeling plate 240. The printing paper P is then sent to the paper receiving unit 216 by the feed rollers 221*a* to 222*b*. Thus, printing papers P on which color images have been printed are sent to the paper receiving unit 216 in sequence, and then stacked on the paper receiving unit 216.

A paper sensor 233 is disposed in between the nip roller 238 and the inkjet head 2 disposed the most upstream in the conveyance direction of printing papers P. The paper sensor 233 is constituted by a light emitting element and a light receiving element. The paper sensor 233 can detect the leading edge of each printing paper P on the conveyance path. The result of detection by the paper sensor 233 is sent to the controller 100. On the basis of the detection result sent from the paper sensor 233, the controller 100 can control the inkjet heads 2, the conveyance motor 174, and so on, so that the conveyance of printing papers P is synchronized with printing of images.

Figure 2:
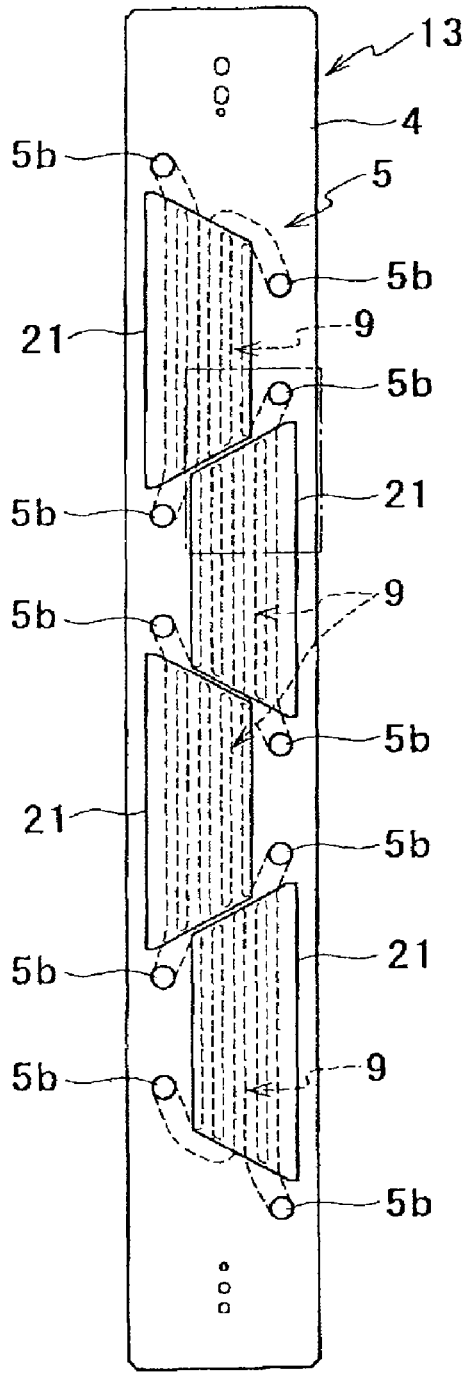
FIG. 2 is an upper view of a head main body of an inkjet head shown in FIG. 1.

The head main body 13 of each inkjet head 2 will be described. FIG. 2 is an upper view of a head main body 13 shown in FIG. 1.

The head main body 13 includes a passage unit 4 and four actuator units 21 each bonded onto the passage unit 4. Each actuator unit 21 is substantially trapezoidal. Each actuator unit 21 is disposed on the upper surface of the passage unit 4 such that a pair of parallel opposed sides of the trapezoid of the actuator unit 21 extend longitudinally of the passage unit 4. Two actuator units 21 are arranged on each of two straight lines extending parallel to each other longitudinally of the passage unit 4. That is, four actuator units 21 in total are arranged zigzag on the passage unit 4 as a whole. Each neighboring oblique sides of actuator units 21 on the passage unit 4 partially overlap each other laterally of the passage unit 4.

Manifold channels 5 each of which is part of an ink passage are formed in the passage unit 4. An opening 5*b* of each manifold channel 5 is formed on the upper face of the passage unit 4. Five openings 5*b* are arranged on each of two imaginary straight lines extending parallel to each other longitudinally of the passage unit 4. That is, ten openings 5*b* in total are formed. The openings 5*b* are formed so as to avoid the regions where four actuator units 21 are disposed. Ink is supplied from a not-shown ink tank into each manifold channel 5 through its opening 5*b*.

FIG. 3 is an enlarged upper view of a region enclosed with an alternate long and short dash line in FIG. 2. In FIG. 3, for convenience of explanation, each actuator unit 21 is shown by an alternate long and two short dashes line. In addition, apertures 12, nozzles 8, and so on, are shown by solid lines though they should be shown by broken lines because they are formed in the passage unit 4 or on the lower face of the passage unit 4.

Each manifold channel 5 formed in the passage unit 4 branches into a number of sub manifold channels 5*a*. Each sub manifold channel 5*a* extends along an oblique side of an actuator unit 21 to intersect with a longitudinal axis of the passage unit 4. In each region sandwiched by two actuator units 21, one manifold channel 5 is shared by the neighboring actuator units 21. Sub manifold channels 5*a* are branched from both sides of the manifold channel 5. The sub manifold channels 5*a* extend with neighboring each other in the passage unit 4 in regions opposite to the respective actuator units 21.

The passage unit 4 includes therein pressure chamber groups 9 each constituted by a number of pressure chambers 10 arranged in a matrix. Each pressure chamber 10 is formed into a hollow region having a substantially rhombic shape in a plan view each corner of which is rounded. Each pressure chamber 10 is formed so as to be open at the upper face of the passage unit 4. The pressure chambers 10 are arranged substantially over each region of the upper face of the passage unit 4 opposed to the corresponding actuator unit 21. Thus, each pressure chamber group 9 constituted by the pressure chambers 10 occupies a region having substantially the same size and shape as one actuator unit 21. The opening of each pressure chamber 10 is closed by the corresponding actuator unit 21 bonded onto the upper face of the passage unit 4. In this embodiment, as shown in FIG. 3, sixteen rows of pressure chambers 10, which are arranged longitudinally of the passage unit 4 at regular intervals, are arranged parallel to each other laterally of the passage unit 4. The pressure chambers 10 are disposed such that the number of pressure chambers 10 belonging to each row gradually decreases from the long side toward the short side of the profile of the corresponding piezoelectric actuator 50. The nozzles 8 are disposed likewise. This realizes image formation with a resolution of 600 dpi as a whole.

An individual electrode 35, as will be described later, is formed on the upper face of each actuator unit 21 so as to be opposed to each pressure chamber 10. The individual electrode 35 has its shape somewhat smaller than and substantially similar to the shape of the pressure chamber 10. The individual electrode 35 is disposed so as to be within a region of the upper face of the actuator unit 21 opposed to the corresponding pressure chamber 10.

Either of the pressure chamber 10 and the individual electrode 35 has its shape extending vertically in FIG. 3. Either of the pressure chamber 10 and the individual electrode 35 is tapered from its vertical center in FIG. 3 toward either of upward and downward. This realizes dense arrangements of a large number of pressure chambers 10 and a large number of individual electrodes 35.

A large number of nozzles 8 are formed on the passage unit 4. The nozzles 8 are disposed so as to avoid regions of the lower face of the passage unit 4 opposed to the respective sub manifold channels 5*a*. In addition, the nozzles 8 are disposed within regions of the lower face of the passage unit 4 opposed to the respective actuator units 21. The nozzles 8 in each region are arranged at regular intervals on a number of straight lines each extending longitudinally of the passage unit 4.

When the nozzles 8 are projected on an imaginary straight line extending longitudinally of the passage unit 4, perpendicularly to the straight line, the obtained projective points are arranged continuously on the imaginary straight line at regular intervals corresponding to the printing resolution. Thereby, the inkjet head 2 can perform printing continuously at regular intervals corresponding to the printing resolution, substantially over the whole area longitudinal of the region of the passage unit 4 where the nozzles are formed.

A large number of apertures 12, each of which functions as a throttle, are formed in the passage unit 4. The apertures 12 are disposed within regions opposed to the respective pressure chamber groups 9. In this embodiment, each restricted passage 12 extends in one horizontal direction.

Figure 4:
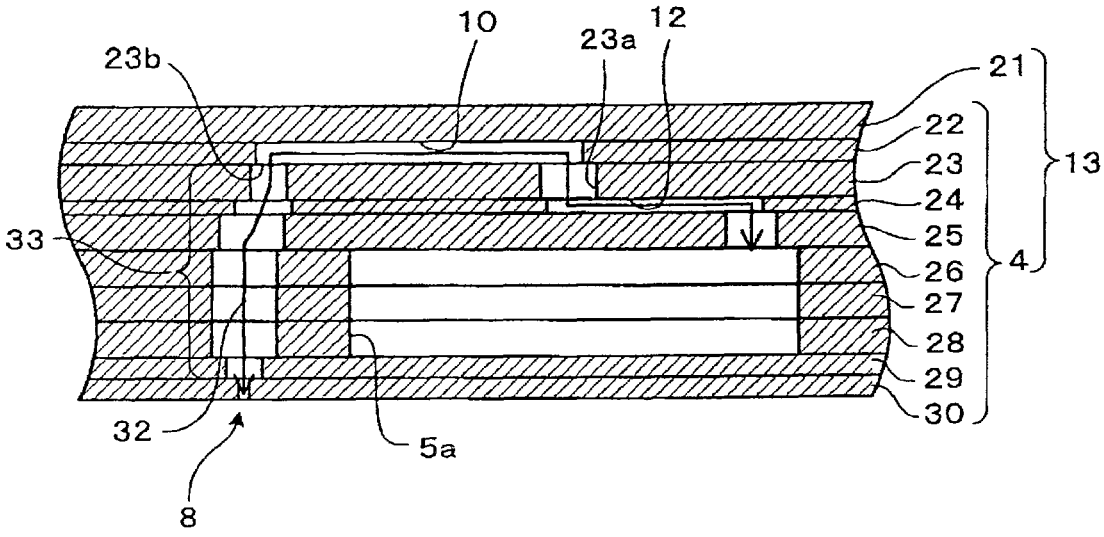
FIG. 4 is a vertically sectional view taken along line IV-IV in FIG. 3.

In the passage unit 4, connection holes are formed so as to connect each corresponding restricted passage 12, pressure chamber 10, and nozzle a with each other. The connection holes are connected with each other to form an individual ink passage 32, as shown in FIG. 4. Each individual ink passage 32 is connected with the corresponding sub manifold channel 5*a*. Ink supplied to each manifold channel 5 is supplied to each individual ink passage 32 via the corresponding sub manifold channel 5*a* and then ejected from the corresponding nozzle 8.

A sectional construction of the head main body 13 will be described. FIG. 4 is a vertically sectional view taken along line IV-IV in FIG. 3.

The passage unit 4 of the head main body 13 has a layered structure in which a number of plates are put in layers. That is, in the order from the upper face of the passage unit 4, there are disposed a cavity plate 22, a base plate 23, an aperture plate 24, a supply plate 25, manifold plates 26, 27, and 28, a cover plate 29, and a nozzle plate 30. A large number of connection holes are formed in the plates 22 to 29. The plates are put in layers after they are positioned so that connection holes formed through the respective plates are connected with each other to form each individual ink passage 32 and each sub manifold channel 5*a*. In the head main body 13, as shown in FIG. 4, portions of each individual ink passage 32 are disposed at different positions close to each other, for example, the pressure chamber 10 is formed in the uppermost layer of the passage unit 4; the sub manifold channel 5*a* is formed in middle layers of the passage unit 4; and the nozzle 8 is formed in the lowermost layer of the passage unit 4. The sub manifold channel 5*a* and the nozzle 8 are connected with each other via the pressure chamber 10 through connection holes.

Connection holes formed through the respective plates will be described. The connection holes include the following portions. The first is a pressure chamber 10 formed through the cavity plate 22. The second is a connection hole A that forms a passage leading from one end of the pressure chamber 10 to a sub manifold channel 5*a*, which will be referred to as second ink passage. The connection hole A is formed through the plates from the base plate 23, more specifically, the inlet of the pressure chamber 10, to the supply plate 25, more specifically, the outlet of the sub manifold channel 5*a*. The connection hole A includes an restricted passage 12 formed through the aperture plate 24.

The third is a connection hole B that forms a passage leading from the other end of the pressure chamber 10 to a nozzle 8. The connection hole B is formed through the plates from the base plate 23, more specifically, the outlet of the pressure chamber 10, to the cover plate 29. In the below, the connection hole B will be referred to as descender 33. The fourth is the nozzle 8 formed through the nozzle plate 30. The fifth is a connection hole C that forms the sub manifold channel 5*a*. The connection hole C is formed through the manifold plates 26 to 28.

The above connection holes are connected with each other to form an individual ink passage 32 leading from an ink inlet port from the sub manifold channel 5*a*, that is, an outlet of the sub manifold channel 5*a*, to the nozzle 8. Ink supplied to the sub manifold channel 5*a* flows to the nozzle 8 in the following passage. First, ink flows upward from the sub manifold channel 5*a* to one end of the restricted passage 12. Next, ink horizontally flows longitudinally of the restricted passage 12 to the other end of the restricted passage 12. Ink then flows upward from the other end of the restricted passage 12 to one end of the pressure chamber 10. Ink then horizontally flows longitudinally of the pressure chamber 10 to the other end of the pressure chamber 10. Ink then flows obliquely downward through three plates and then flows directly below to the nozzle 8.

A partial passage 23*b* formed through the base plate 23 and the nozzle 8 are narrower than any portion of the descender 33 other than the partial passage 23*b*. In other words, as for cross sections of the descender 33 perpendicular to a longitudinal axis of the descender 33, which axis extends along a both-headed arrow of FIG. 4 indicating the individual ink passage 32, the cross sectional areas of the partial passage 23*b* and the nozzle 8 are smaller than the cross sectional area of any other portion of the descender 33. This is a structure in which a proper oscillation both ends of which are at the nozzle 8 and near the connection hole 23*b* is relatively apt to be generated in ink filling up the descender 33.

In addition, the area of the cross section of the restricted passage 12 perpendicular to a longitudinal axis of the restricted passage 12, which axis extends along the both-headed arrow of FIG. 4 indicating the individual ink passage 32, is smaller than the area of the cross section of a partial passage 23*a* formed through the base plate 23, that is, the second passage, which cross section is perpendicular to a vertical axis of the partial passage 23*a*. Thus, the restricted passage 12 functions as a throttle. This realizes a structure suitable for ink ejection by the fill-before-fire method.

Figure 5:
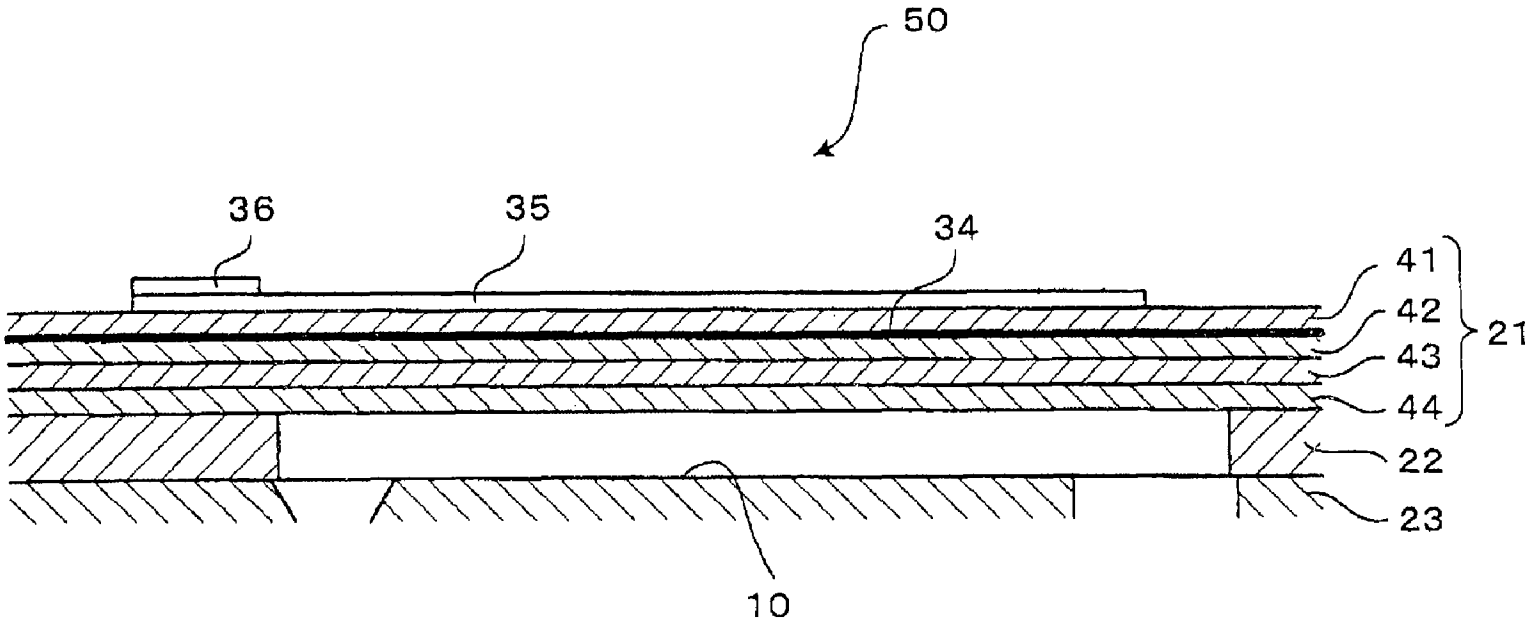
FIG. 5 is a partial enlarged view near a piezoelectric actuator shown in FIG. 4.

As shown in FIG. 5, each actuator unit 21 has a layered structure in which four piezoelectric layers 41, 42, 43, and 44 are put in layers. Each of the piezoelectric layers 41 to 44 has a thickness of about 15 micrometers. The whole thickness of the actuator unit 21 is about 60 micrometers. Any of the piezoelectric layers 41 to 44 is disposed over a number of pressure chambers 10, as shown in FIG. 3. Each of the piezoelectric layers 41 to 44 is made of a piezoelectric zirconate titanate (PZT)-base ceramic material having ferroelectricity.

The actuator unit 21 includes individual electrodes 35 and a common electrode 34, each of which is made of, for example, an Ag—Pd-base metallic material. As described before, each individual electrode 35 is disposed on the upper face of the actuator unit 21 so as to be opposed to the corresponding pressure chamber 10. One end of the individual electrode 35 is extended out of the region opposed to the pressure chamber 10, and a land 36 is formed on the extension. The land 36 is made of, for example, gold containing glass frit. The land 36 has a thickness of about 15 micrometers and is convexly formed. The land 36 is electrically connected to a contact provided on a not-shown flexible printed circuit (FPC). As will be described later, the controller 100 supplies a voltage pulse to each individual electrode 35 via the FPC.

The common electrode 34 is interposed between the piezoelectric layers 41 and 42 so as to spread over substantially the whole area of the interface between the layers. That is, the common electrode 34 spreads over all pressure chambers 10 in the region opposed to the actuator unit 21. The common electrode 34 has a thickness of about 2 micrometers. The common electrode 34 is grounded in a not-shown region to be kept at the ground potential. In this embodiment, a not-shown surface electrode different from the individual electrodes 35 is formed on the piezoelectric layer 41 so as to avoid the group of the individual electrodes 35. The surface electrode is electrically connected to the common electrode 34 via a through hole formed through the piezoelectric layer 41. Like a large number of individual electrodes 35, the surface electrode is connected to another contact and wiring on the FPC 50.

As shown in FIG. 5, each individual electrode 35 and the common electrode 34 are disposed so as to sandwich only the uppermost piezoelectric layer 41. The region of the piezoelectric layer sandwiched by the individual electrode 35 and the common electrode 34 is called active portion. In the actuator unit 21 of this embodiment, only the uppermost piezoelectric layer 41 includes therein such active portions and the remaining piezoelectric layers 42 to 44 includes therein no active portions. That is, the actuator unit 21 has a structure of a so-called unimorph type.

As will be described later, when a predetermined voltage pulse is selectively supplied to each individual electrode 35, pressure is applied to ink in the pressure chamber 10 corresponding to the individual electrode 35. Thereby, ink is ejected from the corresponding nozzle 8 via the corresponding individual ink passage 32. That is, a portion of the actuator unit 21 opposed to each pressure chamber 10 serves as an individual piezoelectric actuator 50 corresponding to the pressure chamber 10 and the corresponding nozzle 8. In the layered structure constituted by four piezoelectric layers, such an actuator as a unit structure as shown in FIG. 5 is formed for each pressure chamber 10. The actuator unit 21 is thus constructed. In this embodiment, the amount of ink to be ejected from a nozzle 8 in one ejection operation is about 5 to 7 pl (picoliters).

In this embodiment, each individual ink passage 32 and each piezoelectric actuator 50 are designed so that Tc1 and Tc2 defined by the following Expressions 1 and 2 satisfy a condition that Tc1/Tc2 is not less than 4.7 and not more than 5.5, preferably, a condition that Tc1/Tc2 is not less than 4.8 and not more than 5.4. Tc1 and Tc2 depend on the shapes and sizes of the portions of the individual ink passage 32 and characteristics of the piezoelectric actuator 50. The individual ink passage 32 and the piezoelectric actuator 50 are designed on the basis of relations between Tc1 and Tc2 and the above parameters. That is, parameters are selected so that Tc1 and Tc2 satisfy the above condition. The relations between the parameters and Tc1 and Tc2 will be described in detail in analyses, which will be described later.

$$T_{C1} = 2\pi\sqrt{\left(\frac{M'_n \times M'_r}{M'_n + M'_r}\right) \times (C_a + C_c + C_d + C_s)} \quad \text{[Expression 1]}$$

$$T_{C2} = 2\pi\sqrt{M_{C2} \times C_{C2}} \quad \text{[Expression 2]}$$

In Expressions 1 and 2, M'n, M'r, Mc2, and Cc2 are defined by the following Expressions 3 to 6, respectively. In Expressions 3 to 6, Md, Ms, Ma, Mn, Mr, and Mc represent the inertances of the descender 33, the partial passage 23*a*, the piezoelectric actuator 50, the nozzle 8, the restricted passage 12, and the pressure chamber 10, respectively; and Ca, Cc, Cd, and Cs represent the compliances of the piezoelectric actuator 50, the pressure chamber 10, descender 33, and the partial passage 23*a*, respectively.

$$M'_n = M_n + M_c/2 \quad \text{[Expression 3]}$$

$$M'_r = M_r + M_c/2 \quad \text{[Expression 4]}$$

$$M_{C2} = \frac{M_d \times (M_c \times M_s)}{M_d + M_c + M_s} + M_a \quad \text{[Expression 5]}$$

$$C_{C2} = \frac{C_d \times C_a}{C_d \times C_a} \quad \text{[Expression 6]}$$

Next will be described control of the actuator units 21. For controlling the actuator units 21, the printer 1 includes therein a controller 100 and driver ICs 80. The printer 1 includes therein a central processing unit (CPU) as an arithmetic processor; a read only memory (ROM) storing therein computer programs to be executed by the CPU and data used in the programs; and a random access memory (RAM) for temporarily storing data in execution of a computer program. These and other hardware components constitute the controller 100 having functions as will be described below.

Figure 6:
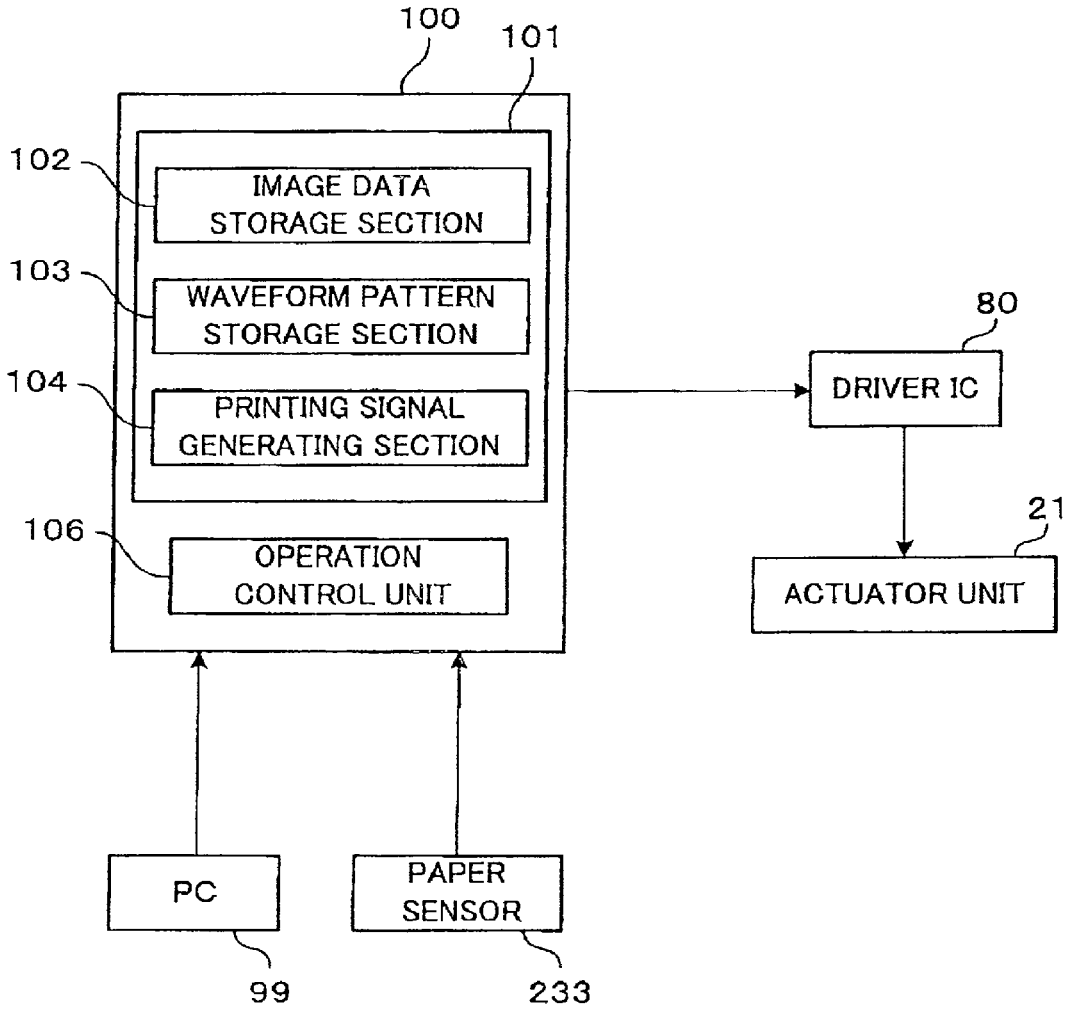
FIG. 6 is a block diagram showing a constitution of a controller included in the printer shown in FIG. 1.

As shown in FIG. 6, the controller 100 includes therein a printing control unit 101 and an operation control unit 106. The printing control unit 101 includes therein an image data storage section 102, a waveform pattern storage section 103, and a printing signal generating section 104. The image data storage section 102 stores therein image data for printing, transmitted from, for example, a personal computer (PC) 99.

The waveform pattern storage section 103 stores therein waveform data corresponding to a number of ejection pulse waveforms. Each ejection pulse waveform corresponds to a basic waveform in accordance with the tone and so on of an image. A voltage pulse signal corresponding to the waveform is supplied to individual electrodes 35 via the corresponding driver IC 80 and thereby an amount of ink corresponding to each tone is ejected from each inkjet head 2.

The printing signal generating section 104 generates serial printing data on the basis of image data stored in the image data storage section 102. The printing data corresponds to one of data items corresponding to the respective ejection pulse waveforms stored in the waveform pattern storage section 103. The printing data is for instructing to supply the ejection pulse waveform to each individual electrode 35 at a predetermined timing. On the basis of image data stored in the image data storage section 102, the printing signal generating section 104 generates printing data in accordance with timings, a waveform, and individual electrodes, corresponding to the image data. The printing signal generating section 104 then outputs the generated printing data to each driver IC 80.

A driver IC 80 is provided for each actuator unit 21. The driver IC 80 includes a shift register, a multiplexer, and a drive buffer, though any of them is not shown.

The shift register converts the serial printing data output from the printing signal generating section 104, into parallel data. That is, following the instruction of the printing data, the shift register outputs an individual data item to the piezoelectric actuator 50 corresponding to each pressure chamber 10 and the corresponding nozzle 8.

On the basis of each data item output from the shift register, the multiplexer selects appropriate one out of the waveform data items stored in the waveform pattern storage section 103. The multiplexer then outputs the selected data item to the drive buffer.

On the basis of the waveform data item output from the multiplexer, the drive buffer generates an ejection voltage pulse signal having a predetermined level. The drive buffer then supplies the ejection voltage pulse signal to the individual electrode 35 corresponding to each piezoelectric actuator 50, via the FPC.

Next will be described an ejection voltage pulse signal and a change in the potential of an individual electrode 35 having received the signal.

Figure 7:
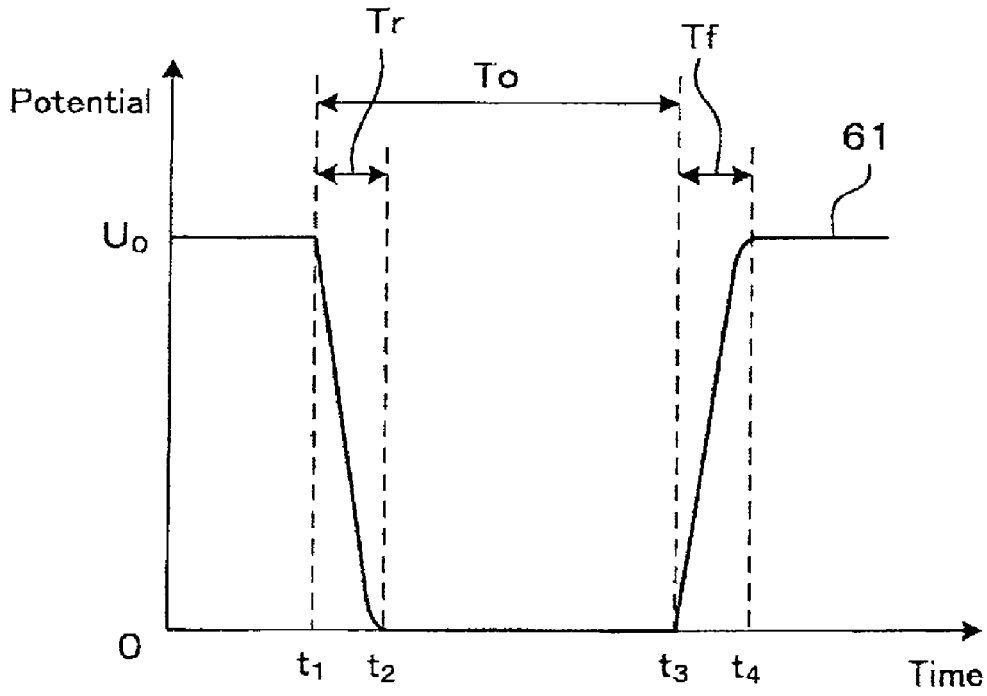
FIG. 7 is a graph showing the waveform of a voltage pulse signal to be supplied to an individual electrode shown in FIG. 5 for ink ejection.

The voltage at each time contained in the ejection voltage pulse signal will be described. FIG. 7 shows an example of a change in the potential of an individual electrode 35 to which the ejection voltage pulse signal is supplied. The waveform 61 of the ejection voltage pulse signal shown in FIG. 7 is an example of a waveform for ejecting one droplet of ink from a nozzle 8.

At a time t1, the ejection voltage pulse signal starts to be supplied to the individual electrode 35. The time t1 is controlled in accordance with a timing at which ink is ejected from the nozzle B corresponding to the individual electrode 35. When the waveform 61 of the ejection voltage pulse signal is supplied, the voltage is kept at U0, which is not zero, in the period to the time t1 and in the period after a time t4. In the period from a time t2 to a time t3, the voltage is kept at the ground potential. The period Tr from the time t1 to the time t2 is a transient period in which the potential of the individual electrode 35 changes from U0 to the ground potential. The period Tf from the time t3 to the time t4 is a transient period in which the potential of the individual electrode 35 changes from the ground potential to U0. The periods Tr and Tf are set to the same time length. As shown in FIG. 5, each piezoelectric actuator 50 has the same construction as a capacitor. Thus, when the potential of the individual electrode 35 changes, the above transient periods appear in accordance with accumulation and emission of electric charges.

In this embodiment, the waveform data of the ejection voltage pulse signals stored in the waveform pattern storage section 103 has been controlled so that Tr and Tf satisfy a condition that either of Tr/Tc2 and Tf/Tc2 is not less than 0.3 and not more than 1.0 when any ejection voltage pulse signal is supplied to the individual electrode 35. In addition, the time period To from the time t1 to the time t3 has been controlled so as to have a length that is 2.40 to 2.65 times the value of Tc2 shown in the above Expression 2.

Next will be described how the piezoelectric actuator 50 is driven when the above ejection voltage pulse signal is supplied to the individual electrode 35.

In each actuator unit 21 of this embodiment, only the uppermost piezoelectric layer 41 has been polarized in the direction from each individual electrode 35 toward the common electrode 34. Thus, when an individual electrode 35 is set at a different potential from the common electrode 34 so as to apply an electric field to the piezoelectric layer 41 in the same direction as that of the polarization, more specifically, in the direction from the individual electrode 35 toward the common electrode 34, the portion to which the electric field has been applied, that is, the active portion, attempts to elongate in the thickness, that is, perpendicularly to the layer. At this time, the active portion attempts to contract parallel to the layer, that is, in the plane of the layer. On the other hand, the remaining three piezoelectric layers 42 to 44 have not been polarized, and they are not deformed by themselves even when an electric field is applied to them.

A difference in distortion is thus generated between the piezoelectric layer 41 and the piezoelectric layers 42 to 44. Therefore, each piezoelectric actuator 50 is deformed as a whole to be convex toward the corresponding pressure chamber 10, that is, to the piezoelectric layers 42 to 44 side, which is called unimorph deformation.

Figure 8A:
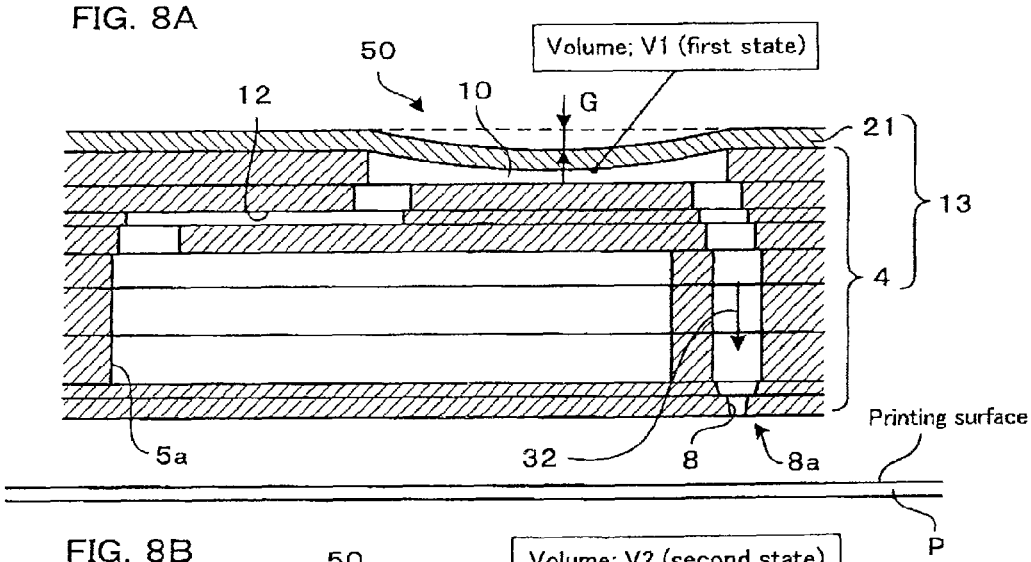
FIGS. 8A to 8C show a driving manner of an actuator unit when the voltage pulse signal shown in FIG. 7 is supplied to the individual electrode.
Figure 8B:
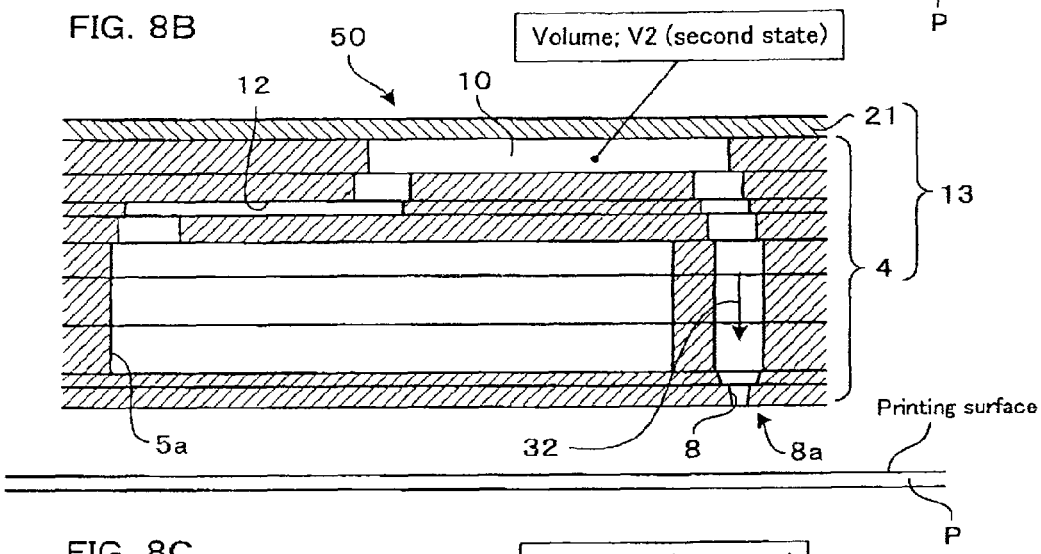
Figure 8C:
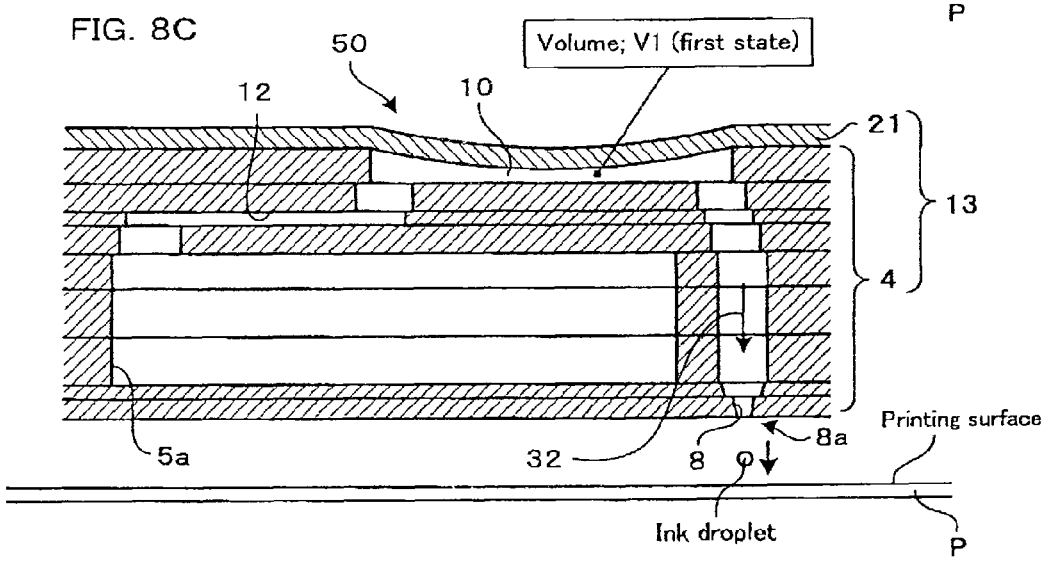

Next will be described drive of a piezoelectric actuator 50 when a voltage pulse signal corresponding to the waveform 61 is supplied to the corresponding individual electrode 35. FIGS. 8A to 8C show a change in the piezoelectric actuator 50 with time.

FIG. 8A shows the state of the piezoelectric actuator 50 in the period to the time t1 shown in FIG. 7. At this time, the potential of the individual electrode 35 is U0. The piezoelectric actuator 50 protrudes into the corresponding pressure chamber 10 by the above-described unimorph deformation. The volume of the pressure chamber 10 at this time is V1. This state of the pressure chamber 10 will be referred to as first state.

FIG. 8B shows the state of the piezoelectric actuator 50 in the period from the time t2 to the time t3 shown in FIG. 7. At this time, the individual electrode 35 is at the ground potential. Therefore, the electric field disappears that was applied to the active portion of the piezoelectric layer 41, and the piezoelectric actuator 50 is released from its unimorph deformation. The volume V2 of the pressure chamber 10 at this time is larger than the volume V1 of the pressure chamber 10 shown in FIG. 8A. This state of the pressure chamber 10 will be referred to as second state. As a result of an increase in the volume of the pressure chamber 10, ink is sucked into the pressure chamber 10 from the corresponding sub manifold channel 5*a*.

FIG. 8C shows the state of the piezoelectric actuator 50 in the period after the time t4 shown in FIG. 7. At this time, the potential of the individual electrode 35 is U0. Therefore, the piezoelectric actuator 50 has been again restored to the first state. By the piezoelectric actuator 50 thus changing the pressure chamber 10 from the second state into the first state, a pressure is applied to ink in the pressure chamber 10. Thereby, an ink droplet is ejected from the corresponding nozzle 8. The ink droplet impacts the printing surface of a printing paper P to form a dot.

As described above, in the drive of the piezoelectric actuator 50 of this embodiment, first, the volume of the pressure chamber 10 is once increased to generate a negative pressure wave in ink in the pressure chamber 10, as shown from FIG. 8A to FIG. 8B. The pressure wave is reflected by an end of the ink passage in the passage unit 4, and thereby returned as a positive pressure wave progressing toward the nozzle 8. With estimating a timing at which the positive pressure wave reaches the interior of the pressure chamber 10, the volume of the pressure chamber 10 is again decreased, as shown from FIG. 8B to FIG. 8C. This is a so-called fill-before-fire method.

In order to realize ink ejection by the above-described fill-before-fire method, the pulse width To of the voltage pulse having the waveform 61 for ink ejection, as shown in FIG. 7, is adjusted to the acoustic length (AL). In this embodiment, each pressure chamber 10 is provided near the center of the whole length of the corresponding individual ink passage 32, and AL is the length of a time period for which a pressure wave generated in the pressure chamber 10 progresses from the corresponding restricted passage 12 to the corresponding nozzle 8. In this construction, the positive pressure wave reflected as described above is superimposed on a positive pressure wave generated because of deformation of the corresponding piezoelectric actuator 50 so that a higher pressure is applied to ink. Therefore, in comparison with a case wherein the volume of the pressure chamber 10 is only once decreased to push ink out, the driving voltage for the piezoelectric actuator 50 is held down when the same amount of ink is ejected. Thus, the fill-before-fire method is advantageous in a highly dense arrangement of pressure chambers 10, compactification of an inkjet head 2, and the running cost for driving the inkjet head 2.

Next will be described a series of analyses performed by the inventors for the present invention.

Figure 9:
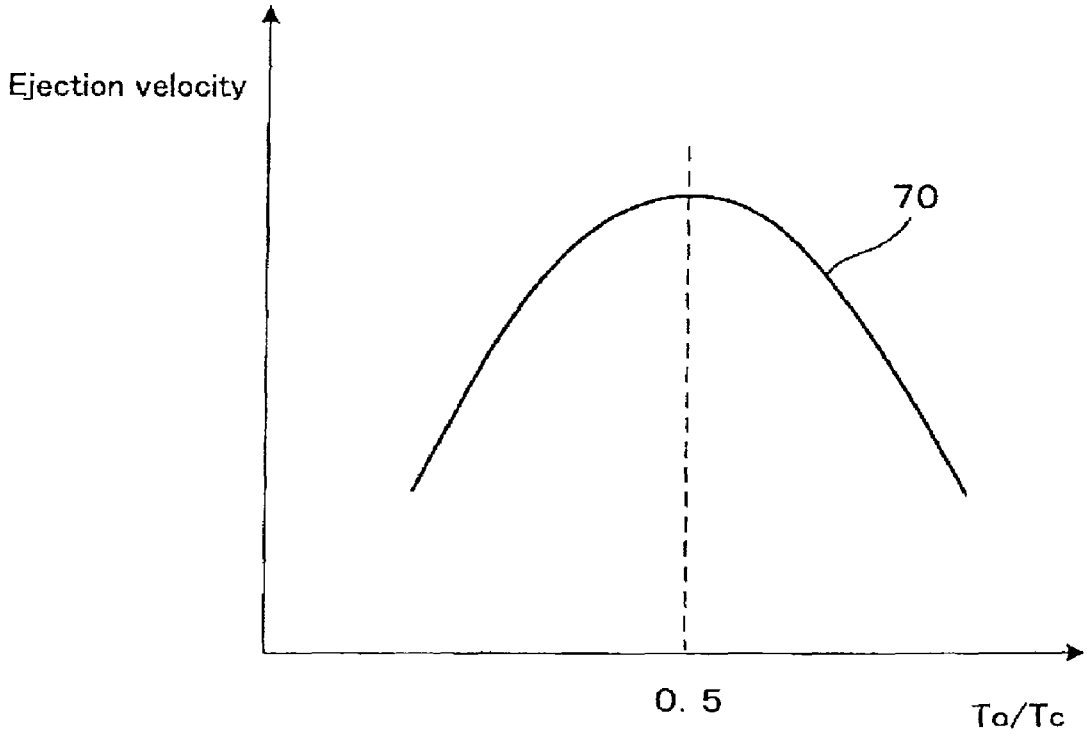
FIG. 9 is a graph showing the ejection velocity of ink ejected from the inkjet head relative to the width of the pulse when the voltage pulse signal shown in FIG. 7 is supplied to the individual electrode.

FIG. 9 is a graph showing a general ejection characteristic of an inkjet head having the same construction as those of the above embodiment, when the head ejects liquid with changing the value of To. In FIG. 9, the axis of abscissas represents the value of To/Tc, and the axis of ordinate represents the liquid ejection velocity. Tc represents a proper oscillation period of the whole of ink filling up an individual ink passage 32 leading from a sub manifold channel 5*a* through a pressure chamber 10 to a nozzle 8, as shown in FIG. 4. As shown by the curved line 70 of FIG. 9, the ink ejection velocity takes a maximum value when a voltage pulse signal satisfying a condition of To/Tc=½ is supplied to the corresponding individual electrode 35. That is, when a voltage pulse signal having its waveform 61 satisfying a condition of To=AL=½Tc is supplied to the individual electrode 35, ink is ejected the most efficiently in ink ejection velocity.

Tc is a parameter depending on the structure of the liquid ejection head. More specifically, it depends on the shape of the individual ink passage 32, the compliance of the piezoelectric actuator 50, and so on. Therefore, when a liquid ejection head having a certain structure ejects ink by the fill-before-fire method, the voltage pulse signal to be supplied to each individual electrode 35 is controlled so as to satisfy the condition of To=AL, on the basis of the value of Tc determined by the structure of the liquid ejection head.

The inventors of the present invention have confirmed that the following problems arise when voltage signals satisfying the condition of To=AL are supplied to individual electrodes 35 of respective liquid ejection heads having various structures. That is, in liquid droplets ejected from the corresponding nozzle 8, the problems arise that (1) a liquid droplet is divided; (2) the amount and ejection velocity of ink droplets reduce relatively to the power consumed for driving the piezoelectric actuator 50, that is, the ejection efficiency of liquid droplets reduces; (3) a low-velocity small liquid droplet is produced after a desired liquid droplet is ejected; (4) the ejection velocity of liquid droplets varies; and so on.

The inventors of the present invention have analyzed the reason for the above problems as follows. First, the inventors of the present invention have confirmed that, other than a proper oscillation on the whole of ink filling up an individual ink passage 32, which oscillation will be hereinafter referred to as long-period proper oscillation, a proper oscillation shorter in period than the long-period proper oscillation, which will be hereinafter referred to as short-period proper oscillation, is generated in the individual ink passage 32. Next, the inventors of the present invention have found that the period Tc1 of the long-period proper oscillation and the period Tc2 of the short-period proper oscillation can be derived by the above Expressions 1 and 2.

The below analysis shows that Expressions 1 and 2 properly derive Tc1 and Tc2. In this analysis, the following liquid ejection head is supposed. The liquid ejection head includes a passage unit and an actuator. In the passage unit formed are a nozzle for ejecting liquid and a common liquid chamber Liquid is supplied to the common liquid chamber. Further, in the passage unit, an individual liquid passage is formed so as to connect with the common liquid chamber. The individual liquid passage includes a first passage whose one end is connected to the nozzle; a pressure chamber whose one end is connected to the other end of the first passage; a second passage whose one end is connected to the other end of the pressure chamber; and a restricted passage whose one end is connected to the other end of the second passage and whose other end is connected to the common liquid chamber. The restricted passage is smaller than the second passage in the area of a section perpendicular to the direction of the flow of liquid. Liquid supplied into the common liquid chamber flows through the individual liquid passage, and then it is ejected from the nozzle to the outside of the passage unit.

The actuator of the liquid ejection head can selectively take a first state in which the volume of the pressure chamber is V1, and a second state in which the volume of the pressure chamber is V2 larger than V1. When the actuator changes from the first state into the second state and then returns to the first state, liquid is ejected from the nozzle.

Figure 10A:
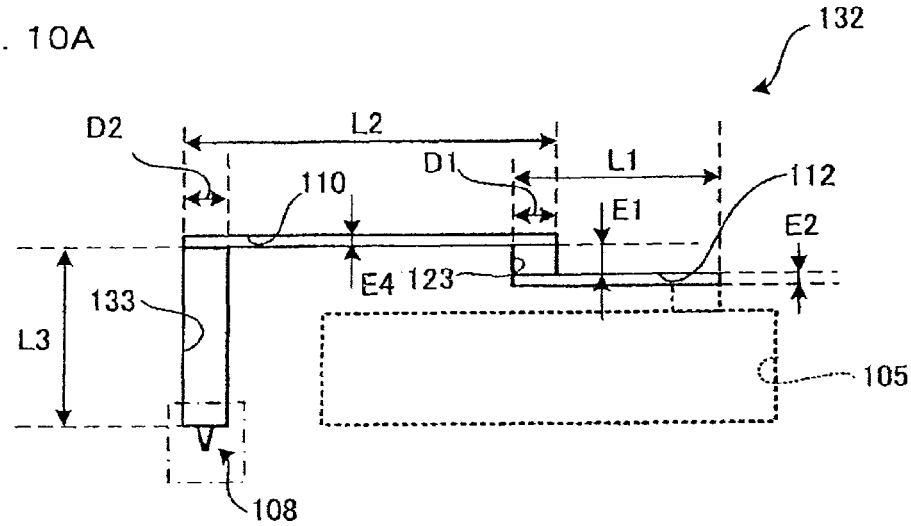
FIG. 10A is a side view of an individual liquid passage used in analyses by the inventors of the present invention.
Figure 10B:
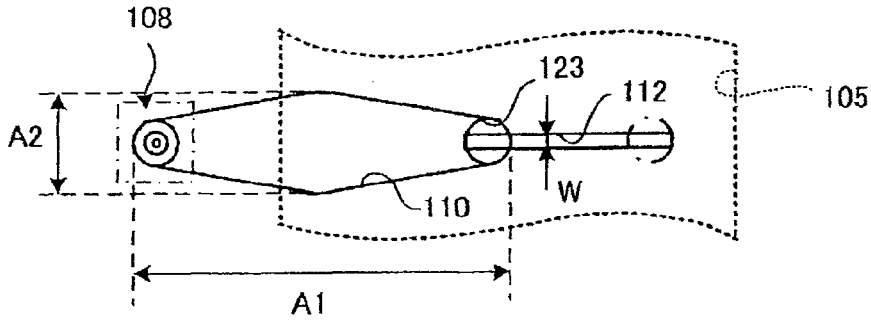
FIG. 10B is an upper view of the individual liquid passage.
Figure 10C:
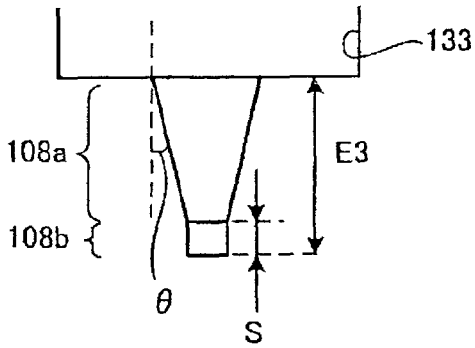
FIG. 10C is an enlarged view of a region enclosed with an alternate long and short dash line in FIG. 10A.
Figure 10D:
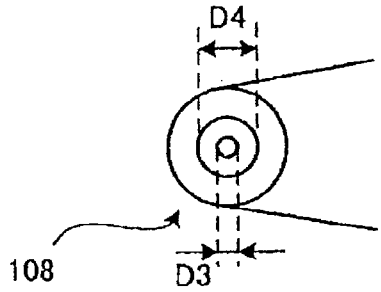
FIG. 10D is an enlarged view of a region enclosed with an alternate long and short dash line in FIG. 10B.
Figure 11:
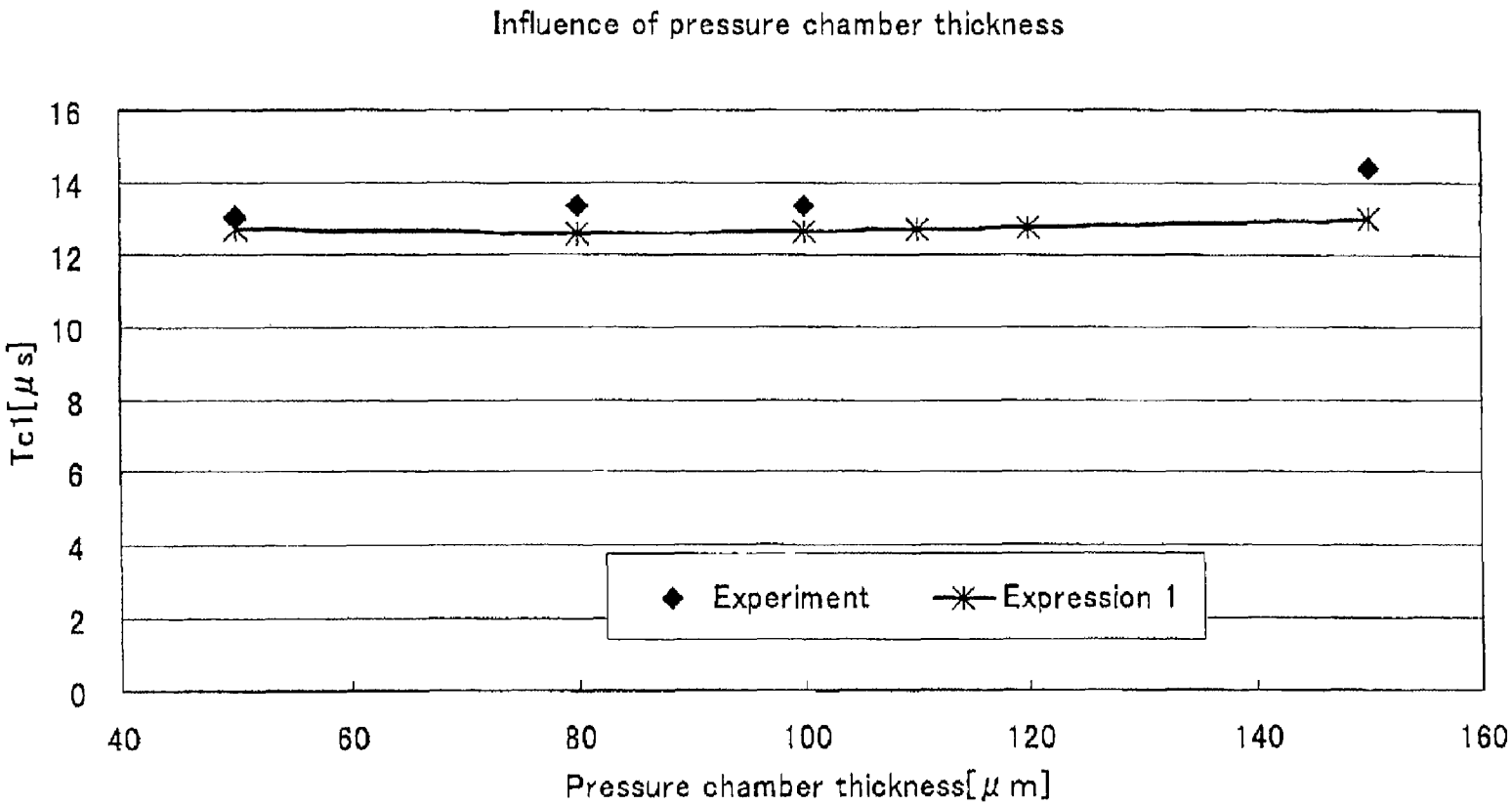
FIG. 11 is a graph showing a relation between the period Tc1 of a long-period proper oscillation and the thickness of a pressure chamber, calculated or measured using the model of FIGS. 10A to 10D.
Figure 12:
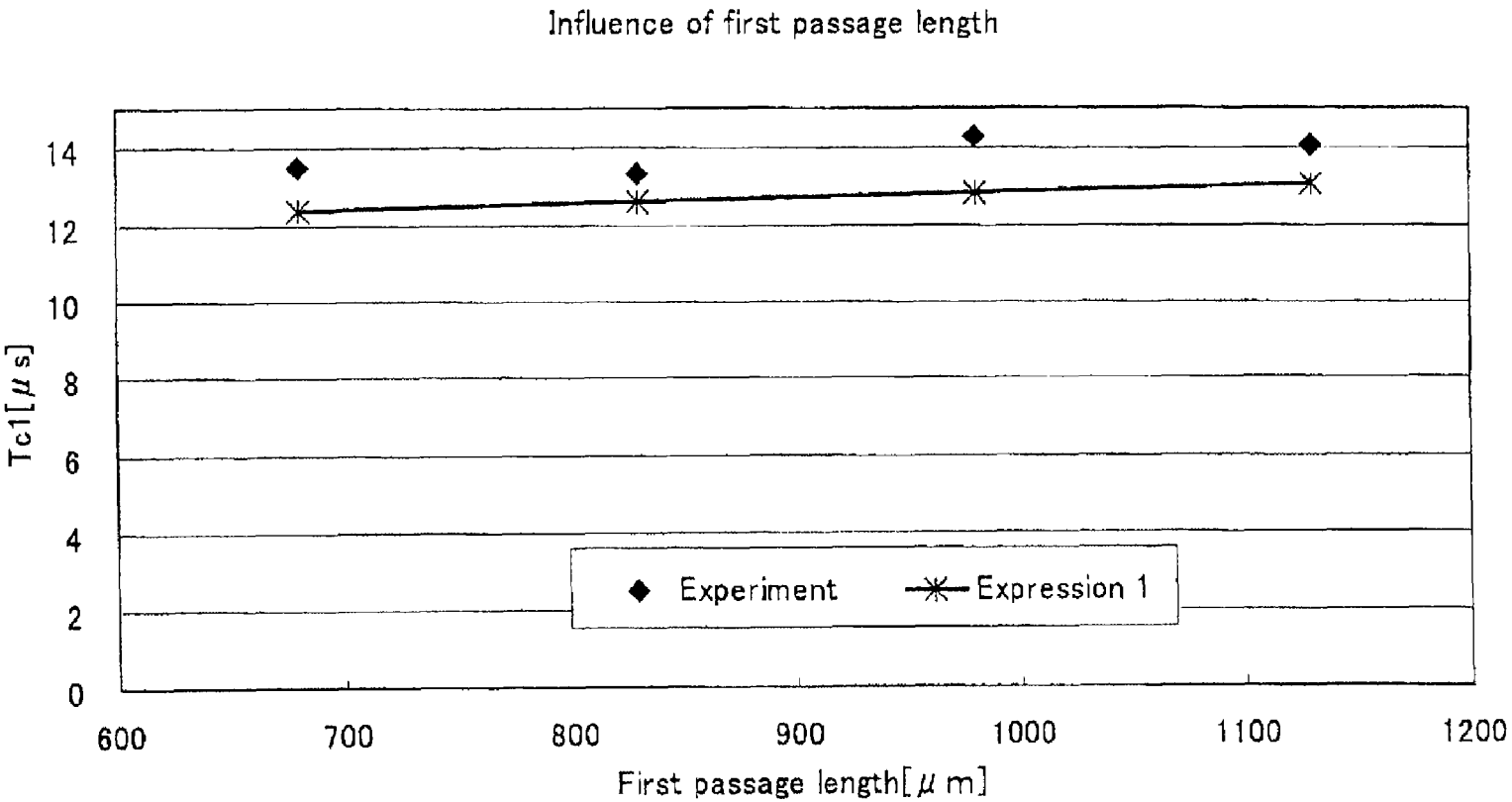
FIG. 12 is a graph showing a relation between the period Tc1 of the long-period proper oscillation and the length of a first passage, calculated or measured using the model of FIGS. 10A to 10D.
Figure 13:
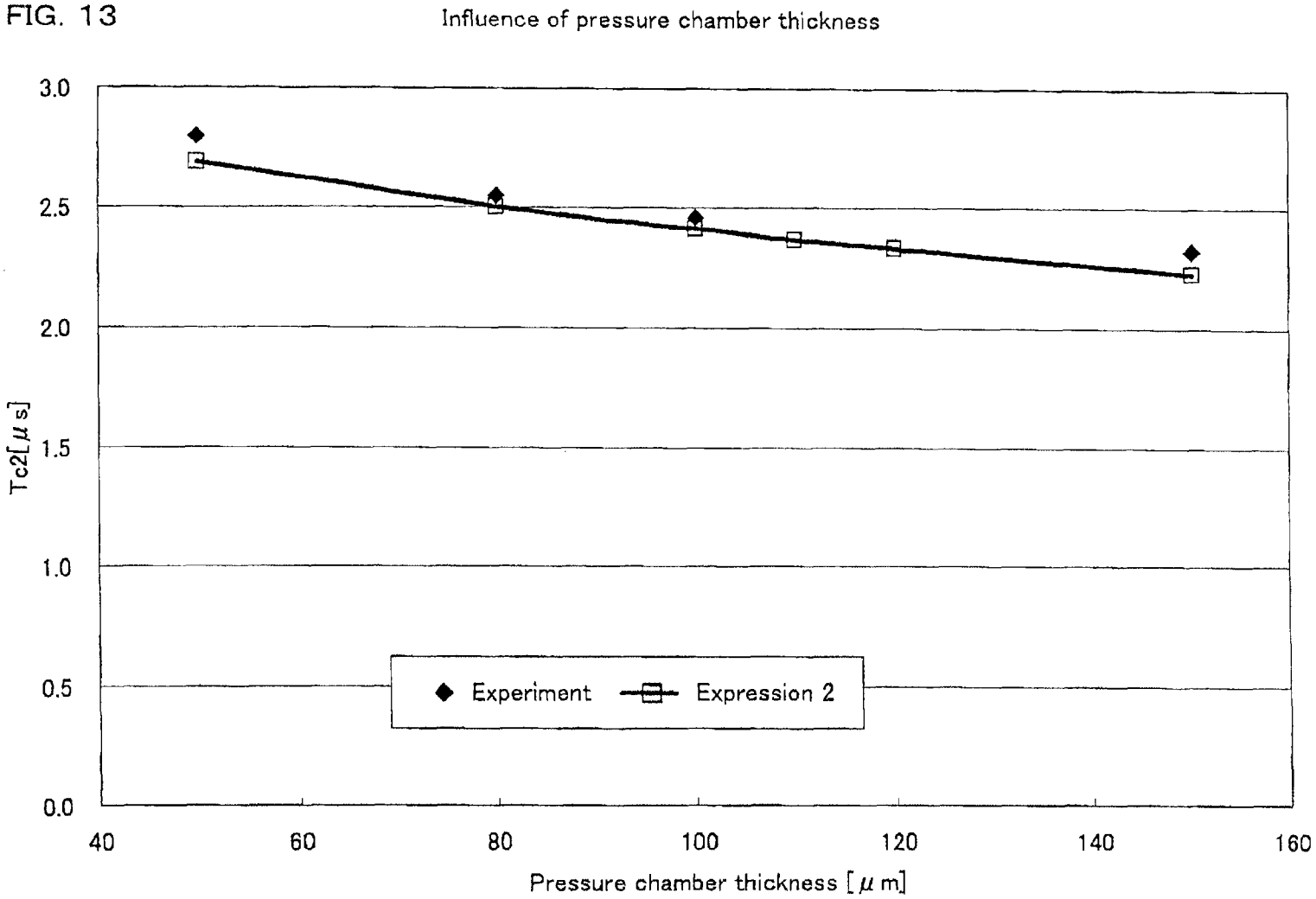
FIG. 13 is a graph showing a relation between the period Tc2 of a short-period proper oscillation and the thickness of the pressure chamber, calculated or measured using the model of FIGS. 10A to 10D.
Figure 14:
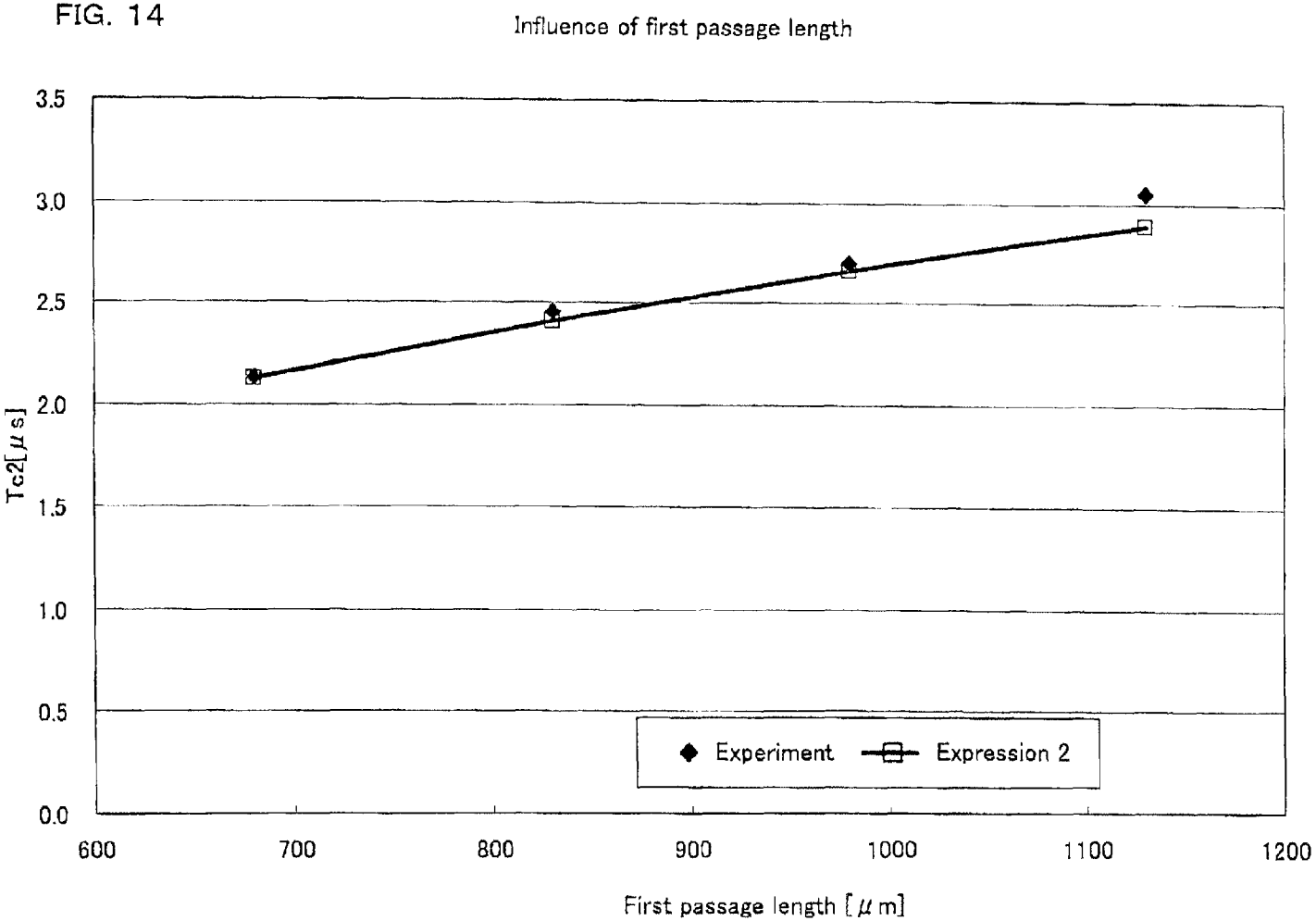
FIG. 14 is a graph showing a relation between the period Tc2 of the short-period proper oscillation and the length of the first passage, calculated or measured using the model of FIGS. 10A to 10D.

The common liquid chamber, the individual liquid passage, the second passage, the restricted passage, the pressure chamber, the first passage, and the nozzle of the above passage unit, correspond to the sub manifold channel 5*a*, the individual ink passage 32, the partial passage 23*a*, the restricted passage 12 and the partial passage 23*a*, the pressure chamber 10, the descender 33, and the nozzle 8, shown in FIG. 4, respectively. FIGS. 10A to 10D show the individual liquid passage 132 of the passage unit supposed in this analysis. FIG. 10A is a side view of the individual liquid passage 132. FIG. 10B is an upper view of the individual liquid passage 132. FIG. 10C is an enlarged view of a region enclosed with an alternate long and short dash line in FIG. 10A. FIG. 10D is an enlarged view of a region enclosed with an alternate long and short dash line in FIG. 10B. As shown in FIGS. 10A and 10B, the passage unit has therein the nozzle 108, the common liquid chamber 105, and the individual liquid passage 132. The individual liquid passage 132 includes the first passage 133 whose one end is connected to the nozzle 108; the pressure chamber 110 whose one end is connected to the other end of the first passage 133; the second passage 123 whose one end is connected to the other end of the pressure chamber 110; and the restricted passage 112 whose one end is connected to the other end of the second passage 123 and whose other end is connected to the common liquid chamber 105. The restricted passage 112 is smaller than the second passage 123 in the area of a section perpendicular to the direction of the flow of liquid. The nozzle 108 is made up of a taper portion 108*a* tapered in section, and a cylindrical straight portion 108*b*.

The sizes of the respective portions of the individual liquid passage 132 are as shown in the below Tables 1 and 4. In this analysis, as for a number of individual liquid passages 132 variously different in the depth E4 of the pressure chamber 110 and the length L4 of the first passage 133, experimental values of Tc1 and Tc2 were compared with their theoretical values according to Expressions 1 and 2. In Table 1, the area of the pressure chamber 110 is the area of the upper face of the pressure chamber 110 shown in FIG. 10B, that is, the area of a horizontal section of the pressure chamber 110. The below Table 2 shows characteristics of liquid filling up the individual liquid passage 132 in this analysis, that is, the density, the viscosity, and so on.

The below Table 3 shows results of calculations of the compliances and inertances of the second passage 123, the restricted passage 112, and the nozzle 108, on the basis of Tables 1 and 2. The below Table 4 shows results of calculations of the compliance and inertance of the pressure chamber 110 with respect to various values of its depth; and results of calculations of the compliance and inertance of the first passage 133 with respect to various values of its length. The value of each compliance was obtained by dividing the volume of each portion by the value obtained by multiplying the square of the acoustic velocity by the density of the liquid. The value of the inertance of each portion was obtained by dividing the value obtained by multiplying the length in the direction of the flow of the liquid by the density of the liquid, by the area of a section perpendicular to the direction of the flow of the liquid, that is, the area of a vertical section. In the calculation of the inertance of the pressure chamber 110, the value obtained by multiplying a half of the length A2 of a short axis of the pressure chamber 110 by the depth E4 of the pressure chamber 110 was used for the section perpendicular to the direction of the flow of the liquid; and the length A1 of a long axis of the pressure chamber 110 was used for the length in the direction of the flow of the liquid. For the acoustic velocity and the density of the liquid, the values shown in Table 2 were used.

TABLE 1

| | | |
|---|---|---|
| Second passage | Diameter D1 [μm] | 180 |
| | Depth E1 [μm] | 100 |
| Restricted passage | Length L1 [μm] | 309 |
| | Width W [μm] | 39.5 |
| | Depth E2 [μm] | 20 |
| Nozzle | Outlet diameter D3 [μm] | 20 |
| | Inlet diameter D4 [μm] | 45.2 |
| | Straight portion length S [μm] | 3 |
| | Taper angle θ [degree] | 15 |
| | Depth E3 [μm] | 50 |
| Pressure chamber | Area [$mm^2$] | 0.2730 |
| | Long-axis length A1 [μm] | 838 |
| | short-axis length A2 [μm] | 468 |
| First passage (descender) | Diameter D2 [μm] | 184 |

TABLE 2

| | |
|---|---|
| Density [$g/cm^3$] | 1.08 |
| Viscosity [cP] | 3.50 |
| ST [D/C] | 38.80 |
| Contact angle [degree] | 20 |
| Liquid head difference [mm] | 20 |
| Acoustic velocity [m/s] | 1440 |

TABLE 3

| | Compliance [$m^5/N$] | Inertance [$kg/m^4$] |
|---|---|---|
| Second Passage | 1.136E−21 | 4.244E+06 |
| Restricted Passage | 3.364E−23 | 4.224E+08 |
| Nozzle | 2.699E−22 | 8.18E+07 |

TABLE 4

| | | Compliance [$m^5/N$] | Inertance [$kg/m^4$] |
|---|---|---|---|
| Pressure chamber depth E4 [μm] | 50 | 6.095E−21 | 7.735E+07 |
| | 80 | 9.752E−21 | 4.835E+07 |
| | 100 | 1.219E−20 | 3.868E+07 |
| | 110 | 1.341E−20 | 3.516E+07 |
| | 120 | 1.463E−20 | 3.223E+07 |
| | 150 | 1.829E−20 | 2.578E+07 |
| First passage (descender) length L3 [μm] | 680 | 8.074E−21 | 2.762E+07 |
| | 830 | 9.855E−21 | 3.371E+07 |
| | 980 | 1.164E−20 | 3.980E+07 |
| | 1130 | 1.342E−20 | 4.590E+07 |

The below Table 5 shows relations between the proper oscillation frequency Fr, the compliance, and the inertance of the actuator supposed in this analysis. The actuator supposed in this analysis may be a piezoelectric actuator such as the piezoelectric actuator 50 shown in FIG. 5, or may be an actuator adopting another system.

TABLE 5

| Actuator Fr [kHz] | Compliance [$m^5/N$] | Inertance [$kg/m^4$] | Generated pressure constant [kPa/V] |
|---|---|---|---|
| 680 | 3.13E−20 | 1.74E+06 | 17.863 |
| 700 | 2.83E−20 | 1.81E+06 | |
| 720 | 2.58E−20 | 1.88E+06 | |

The below Tables 6 and 7 show experimental values of Tc1 and Tc2 derived under the above-described conditions, and theoretical values of Tc1 and Tc2 according to Expressions 1 and 2. FIGS. 11 to 14 are graphs showing the results of Tables 6 and 7. Both of the theoretical and experimental values of Tables 6 and 7 were derived with respect to an actuator whose proper oscillation frequency is 720 kHz.

The theoretical values shown in FIG. 6 are the values of Tc1 calculated by substituting, in the above Expressions 3 and 4, and 1, the compliance and inertance of each portion such as the actuator and the pressure chamber 110 obtained when the depth of the pressure chamber 110 or the length of the first passage 133 is variously changed. The theoretical values shown in FIG. 7 are the values of Tc2 calculated by substituting, in the above Expressions 5 and 6, and 2, the compliance and inertance of each portion such as the actuator and the pressure chamber 110 obtained when the proper oscillation frequency of the actuator and the depth of the pressure chamber 110 or the length of the first passage 133 are variously changed.

In this analysis, of the conditions used for the calculation of the theoretical values, the conditions of the portions other than the depth of the pressure chamber 110 and the length of the first passage 133 were as shown in the above Tables 1, 3, and 4. In either of Tables 6 and 7, the values of the second to seventh rows were calculated with fixing the length of the first passage 133 to 830 micrometers. In either of Tables 6 and 7, the values of the eighth to eleventh rows were calculated with fixing the depth of the pressure chamber 110 to 100 micrometers.

The experimental values shown in Tables 6 and 7 were obtained by actually measuring Tc1 and Tc2 in liquid ejection heads whose pressure chambers 110 have their depths shown in the second column of each of Tables 6 and 7 or whose first passages 133 have their lengths shown in the second column of each of Tables 6 and 7. In the liquid ejection heads used in this experiment, the conditions of the portions other than the depth of the pressure chamber 110 and the length of the first passage 133 were as shown in the above Tables 1, 3, and 4.

The experimental values of Tc1 and Tc2 were obtained as follows. First, each of the passage units having their structures as shown in Tables 6 and 7 was filled up with liquid. Next, a sine wave signal was applied to the corresponding actuator at a low voltage so that liquid was not ejected. The meniscus vibration velocity was then measured with a laser Doppler vibrometer with scanning in a range of 30 to 800 kHz. Each of Tc1 and Tc2 was then obtained by calculating the resonance period from the frequency corresponding a peak of the vibration velocity in the measurement results.

TABLE 6

| | | Theoretical value | Experimental value |
|---|---|---|---|
| Pressure chamber depth [μm] | 50 | 12.72 | 13.05 |
| | 80 | 12.55 | 13.33 |
| | 100 | 12.62 | 13.33 |
| | 110 | 12.68 | — |
| | 120 | 12.75 | — |
| | 150 | 13.01 | 14.40 |
| First passage (descender) length [μm] | 680 | 12.38 | 13.51 |
| | 830 | 12.62 | 13.33 |
| | 980 | 12.84 | 14.29 |
| | 1130 | 13.07 | 14.08 |

TABLE 7

| | | Theoretical value | Experimental value |
|---|---|---|---|
| Pressure chamber depth [μm] | 50 | 2.68 | 2.79 |
| | 80 | 2.50 | 2.55 |
| | 100 | 2.41 | 2.46 |
| | 110 | 2.37 | — |
| | 120 | 2.33 | — |
| | 150 | 2.23 | 2.33 |
| First passage (descender) length [μm] | 680 | 2.12 | 2.13 |
| | 830 | 2.41 | 2.46 |
| | 980 | 2.66 | 2.70 |
| | 1130 | 2.89 | 3.05 |

As shown in Tables 6 and 7 and FIGS. 11 to 14, the experimental values well correspond to the respective theoretical values. This shows that Expressions 1 and 2 properly derive Tc1 and Tc2, respectively.

Next, the inventors of the present invention carried out an experiment as to how ejection characteristics of liquid ejected from a nozzle change in various liquid ejection heads different in Tc1/Tc2; and then analyzed the experimental results. The analysis will be described below.

Figure 15:
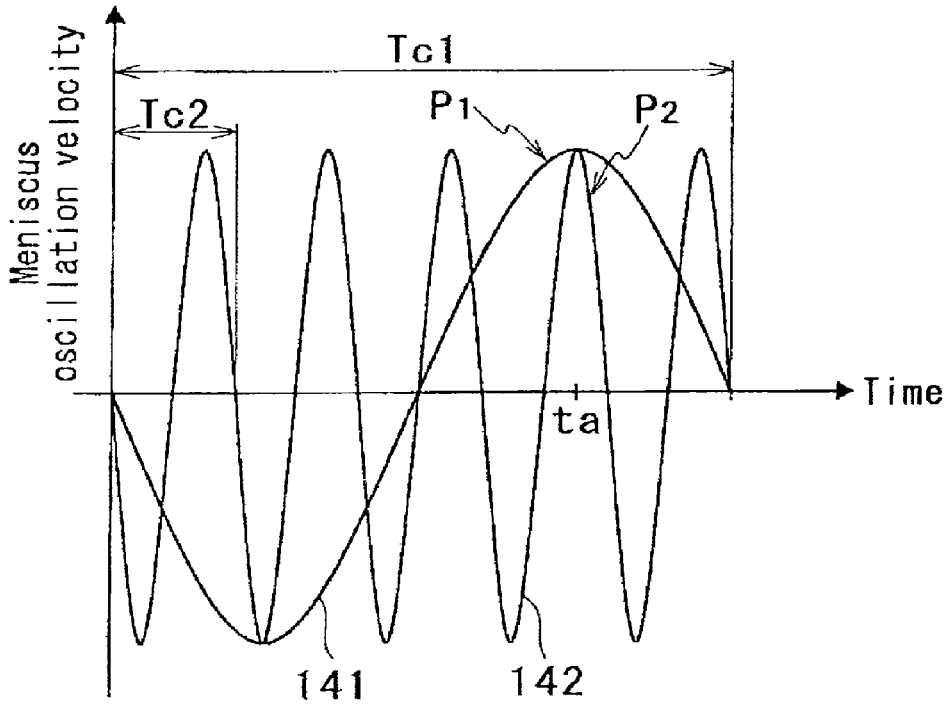
FIG. 15 is a graph showing oscillation of a liquid meniscus at the front end of a nozzle generated due to the long- and short-period proper oscillations in the liquid in the individual liquid passage shown in FIGS. 10A to 10D.

FIG. 15 is a graph showing oscillations of the liquid meniscus at the front end of a nozzle generated due to long- and short-period proper oscillations. In FIG. 15, the axis of ordinate represents the oscillation velocity at the liquid meniscus, and the axis of abscissas represents the time. A curved line 141 represents an oscillation generated at the meniscus due to a long-period proper oscillation. A curved line 142 represents an oscillation generated at the meniscus due to a short-period proper oscillation.

The graph of FIG. 15 shows a case wherein the period of the long-period proper oscillation is just five times the period of the short-period proper oscillation. In this analysis, liquid ejection heads were supposed in which the period of the long-period proper oscillation is approximately five times the period of the short-period proper oscillation. This is for the following reason. By making a peak P1 of the long-period proper oscillation coincide with a peak P2 of the short-period proper oscillation, for example, at a time ta, the oscillation of the meniscus is stable. For making the period of the long-period proper oscillation coincide with a peak of the short-period proper oscillation, a condition of $0.25\times Tc1=(n+0.25)\times Tc2$, where n is a natural number, should be satisfied. In the case of n not less than two, however, because the period of the short-period proper oscillation is too short, the meniscus is excessively finely divided and thus ejection characteristics are not stabilized. The inventors of the present invention have confirmed that the ejection characteristics are stabilized in the vicinity of n=1.

Next, the inventors of the present invention thought that a liquid ejection head is preferably realized in which the peak P2 of the short-period proper oscillation appears temporally somewhat before the peak P1 of the long-period proper oscillation. This is for the following reason. When fill-before-fire is performed in accordance with the peak P2 of the short-period proper oscillation, the ejection characteristics are hard to vary relatively to variation in actuators, in comparison with a case wherein fill-before-fire is performed in accordance with the peak P1 of the long-period proper oscillation. In the case that liquid is ejected from a nozzle in accordance with the peak P2 of the short-period proper oscillation, when the peak P1 of the long-period proper oscillation appears after the peak 22 of the short-period proper oscillation, a tail portion of a liquid droplet that is going to be ejected from the nozzle, which portion connects the rear end of the droplet to the meniscus, is pushed out by the peak P1. This can make a united form of a liquid droplet to be ejected from the nozzle. Contrastingly, if the peak P2 of the short-period proper oscillation appears after the peak P1 of the long-period proper oscillation, such a united liquid droplet can not be ejected.

In consideration of the above, the inventors of the present invention carried out an experiment and an analysis as to how the ejection characteristics of liquid ejected from a nozzle change in various liquid ejection heads in which the value of Tc1/Tc2 is near five. From results of the experiment and analysis, the inventors of the present invention first found that the ejection characteristics of liquid ejected from the nozzle are classified into first to third types. The first to third types correspond to a case wherein Tc1/Tc2 is less than 4.7; a case wherein Tc1/Tc2 is not less than 4.7 and not more than 5.5; and a case wherein Tc1/Tc2 is more than 5.5; respectively. FIGS. 16A to 16F are graphs showing relations between the long- and short-period proper oscillations in respective liquid ejection heads showing the ejection characteristics classified into the first to third types, when the timing for applying pressure is changed.

Figure 16A:
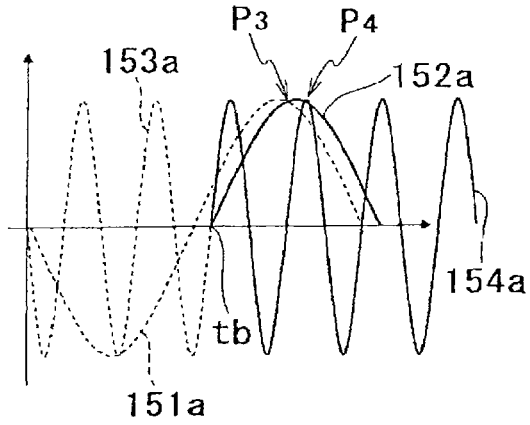
FIGS. 16A to 16F are graphs showing relations between the long- and short-period proper oscillations generated in the individual liquid passage shown in FIGS. 10A to 10D, according to three types of liquid ejection heads and two kinds of timings for applying pressure.
Figure 16B:
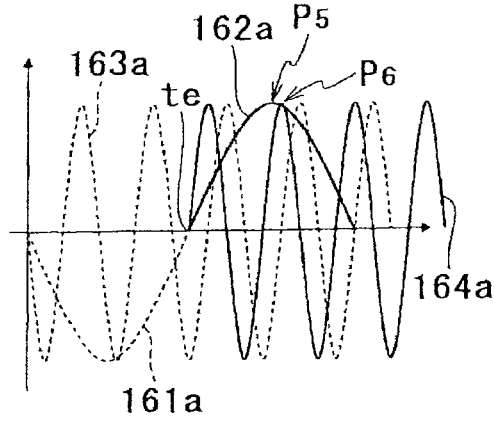
Figure 16C:
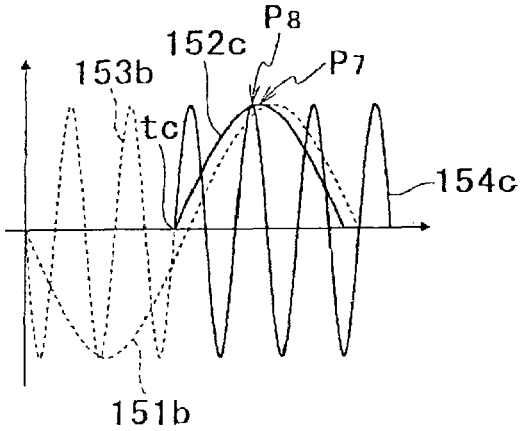
Figure 16D:
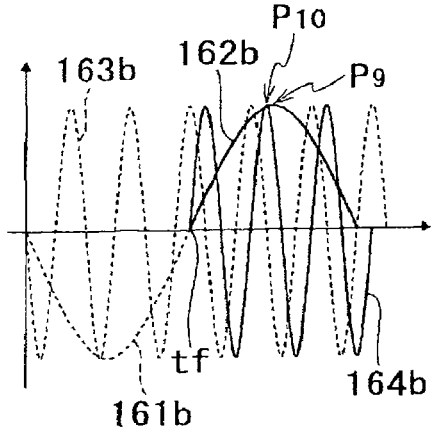
Figure 16E:
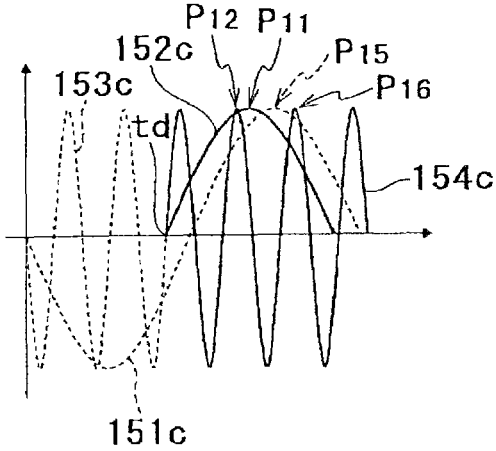
Figure 16F:
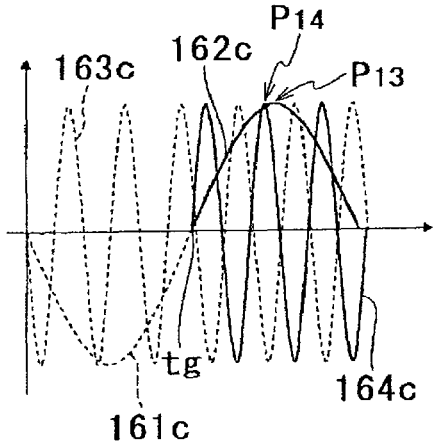

In any of FIGS. 16A to 16F, the axis of abscissas represents the time, and the axis of ordinate represents the oscillation velocity of the liquid meniscus. Any of FIGS. 16A to 16F shows two kinds of oscillations, that is, an oscillation generated due to a negative pressure applied and an oscillation generated due to a positive pressure applied in one liquid ejection operation in the fill-before-fire method. FIGS. 16A, 16C, and 16E show cases wherein timings for applying the positive pressure, that is, times tb, tc, and td, are accorded with the phase of the short-period proper oscillation. FIGS. 16B, 16D, and 16F show cases wherein such timings; that is, times te, tf, and tg, are accorded with the phase of the long-period proper oscillation.

For the below reason, there are two kinds of cases wherein the above timing is accorded to the phase of the short-period proper oscillation, and wherein the above timing is accorded to the phase of the long-period proper oscillation. In the fill-before-fire method, the reason why the above timing is accorded to the phase of the proper oscillation generated due to the negative pressure applied, is for efficiently ejecting liquid by superimposing the proper oscillation generated due to the positive pressure applied, on the proper oscillation generated due to the negative pressure applied. In the case of this analysis in which the period of the long-period proper oscillation is somewhat shifted from integral times the period of the short-period proper oscillation, the timing can not be accorded to the phase of the short-period proper oscillation when the timing is accorded to the phase of the long-period proper oscillation; and the timing can not be accorded to the phase of the long-period proper oscillation when the timing is accorded to the phase of the short-period proper oscillation. Therefore, in either case, the ejection characteristics must be examined.

In FIGS. 16A to 16F, curved lines 151*a* to 151*c* and 161*a* to 161*c* represent long-period proper oscillations generated due to a negative pressure applied. Curved lines 152*a* to 152*c* and 162*a* to 162*c* represent long-period proper oscillations generated due to a positive pressure applied. Curved lines 153*a* to 153*c* and 163*a* to 163*c* represent short-period proper oscillations generated due to a negative pressure applied. Curved lines 154*a* to 154*c* and 164*a* to 164*c* represent short-period proper oscillations generated due to a positive pressure applied.

In the graphs of FIGS. 16A and 16B, peaks P3 and P5 of the long-period proper oscillations temporally precede peaks P4 and P6 of the short-period proper oscillations, respectively. Contrastingly in the graphs of FIGS. 16C and 16D, peaks P8 and P10 of the short-period proper oscillations temporally precede peaks P7 and P9 of the long-period proper oscillations, respectively. Also in the graphs of FIGS. 16E and 16F, peaks 212 and P14 of the short-period proper oscillations temporally precede peaks P11 and P13 of the long-period proper oscillations, respectively.

FIGS. 17A to 17F show states of liquid droplets ejected from a nozzle 108 under the respective conditions of FIGS. 16A to 16F. FIGS. 17A to 17F correspond to FIGS. 16A to 16F, respectively.

Figure 17A:
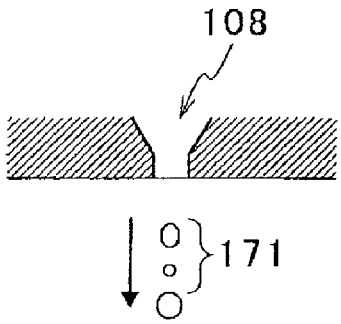
FIGS. 17A to 17F are representations showing ejection states of liquid ejected according to conditions corresponding to FIGS. 16A to 16F, respectively.

An ejection characteristic corresponding to FIGS. 16A and 17A is as follows. The timing of ejecting a positive pressure is accorded to the phase of the short-period proper oscillation. The peak P4 of the short-period proper oscillation appears temporally behind the peak P3 of the long-period proper oscillation. As a result, a liquid droplet ejected from the nozzle 108 is divided to produce tail liquid droplets 171.

Figure 17B:
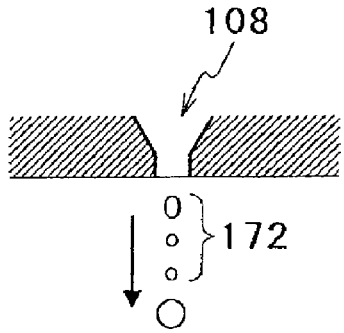

The ejection characteristic corresponding to FIGS. 16B and 17B is as follows. The timing of ejecting a positive pressure is accorded to the phase of the long-period proper oscillation. Therefore, because the phase of the short-period proper oscillation generated due to a negative pressure applied is shifted from the phase of the short-period proper oscillation generated due to the positive pressure applied, a tail liquid droplet 172 is divided and liquid droplets are not united.

Figure 17C:
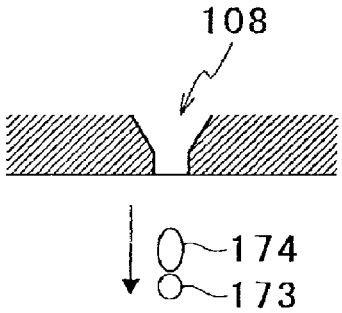

The ejection characteristic corresponding to FIGS. 16C and 17C is as follows. The timing of ejecting a positive pressure is accorded to the phase of the short-period proper oscillation. A tail-liquid droplet 174 is pushed out by the peak P7 of the long-period proper oscillation from behind a temporally preceding liquid droplet 173 ejected by the peak PB of the short-period proper oscillation. Because the phase of the short-period proper oscillation generated due to a negative pressure applied, coincides with the phase of the short-period proper oscillation generated due to the positive pressure applied, the preceding liquid droplet 173 and the tail liquid droplet 174 are united with each other.

Figure 17D:
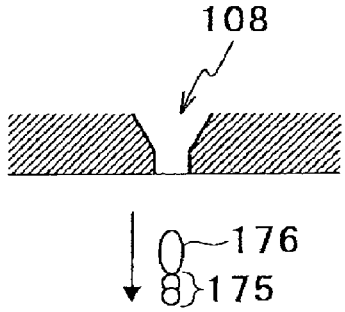

The ejection characteristic corresponding to FIGS. 16D and 17D is as follows. A temporally preceding liquid droplet 175 is divided. However, because a tail liquid droplet 176 catches up from behind the preceding liquid droplets 175, the influence of the divided preceding liquid droplets 175 in impacting is relatively little.

Figure 17E:
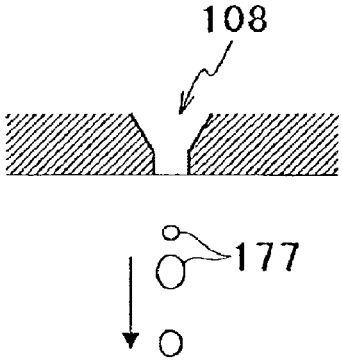

The ejection characteristic corresponding to FIGS. 16E and 17E is as follows. Because the peak P15 of the long-period proper oscillation generated due to a negative pressure applied is widely shifted from the peak P11 of the long-period proper oscillation generated due to a positive pressure applied, liquid can not efficiently be ejected. Low-velocity tail liquid droplets 177 are ejected by the peak P16 of the short-period proper oscillation. The tail liquid droplets 177 having impacted a printing paper or the like bring about noises on the paper.

Figure 17F:
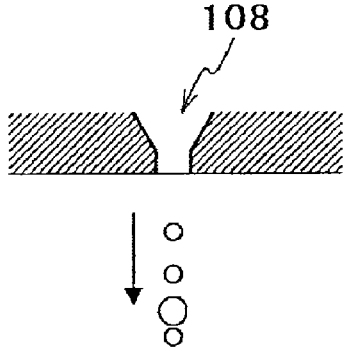

The ejection characteristic corresponding to FIGS. 16F and 17F is as follows. The short-period proper oscillation generated due to a negative pressure applied and the short-period proper oscillation generated due to a positive pressure applied are reversed in phase from each other. This makes the meniscus oscillation unstable. As a result, liquid droplets ejected from the nozzle 108 vary in velocity.

Results of the above-described experiment and analysis are collected up in the below Table 8. Table 8 shows relations of the length of the first passage 133 and the thickness of the pressure chamber 110 to Tc1/Tc2, and evaluations of the ejection characteristic of liquid ejected from liquid ejection heads having the shown values of Tc1/Tc2. The evaluation of the ejection characteristic is shown in three levels. The mark "circle" shows that the ejection characteristic is good. The mark "triangle" shows that the ejection characteristic brings about no practical problem though disturbance arises in tail liquid droplets ejected from the nozzle 108 in comparison with the case of "circle". The mark "cross" shows that the ejection characteristic is practically inappropriate because, for example, the preceding liquid droplet and tail liquid droplets are widely separated from each other in comparison with the case of "triangle".

In Table 8, "Ejection velocity peak" shows whether the ejection velocity of a liquid droplet ejected from the nozzle 108 becomes the maximum when the timing of applying a positive pressure is accorded to one of the phases of the long- and short-period proper oscillations. "Tc1×0.5" indicates that the ejection velocity becomes the maximum when the above timing is accorded to the phase of the long-period proper oscillation. "Tc2×2.5" indicates that the ejection velocity becomes the maximum when the above timing is accorded to the phase of the short-period proper oscillation. These were obtained from the results of the above-described experiment and analysis. The ejection characteristic of Table 8 was evaluated in each case wherein liquid droplets were ejected at the timing that brings about the maximum ejection velocity.

TABLE 8

| First passage length [μm] | Pressure chamber thickness [μm] | Tc1 [μs] | Tc2 [μs] | Tc1/Tc2 | Ejection velocity peak | Ejection characteristic evaluation |
|---|---|---|---|---|---|---|
| 830 | 50 | 12.72 | 2.68 | 4.7 | Tc1 × 0.5 | Δ |
| | 80 | 12.55 | 2.50 | 5.0 | Tc2 × 2.5 | ○ |
| | 100 | 12.62 | 2.41 | 5.2 | Tc2 × 2.5 | ○ |
| | 110 | 12.68 | 2.37 | 5.4 | Tc2 × 2.5 | ○ |
| | 120 | 12.75 | 2.33 | 5.5 | Tc2 × 2.5 | Δ |
| | 150 | 13.01 | 2.23 | 5.8 | Tc1 × 0.5 | X |
| 680 | 100 | 12.38 | 2.12 | 5.8 | Tc2 × 2.5 | X |
| 830 | | 12.62 | 2.41 | 5.2 | Tc2 × 2.5 | ○ |
| 980 | | 12.84 | 2.66 | 4.8 | Tc2 × 2.5 | ○ |
| 1180 | | 13.07 | 2.89 | 4.5 | Tc1 × 0.5 | X |

Figure 18:
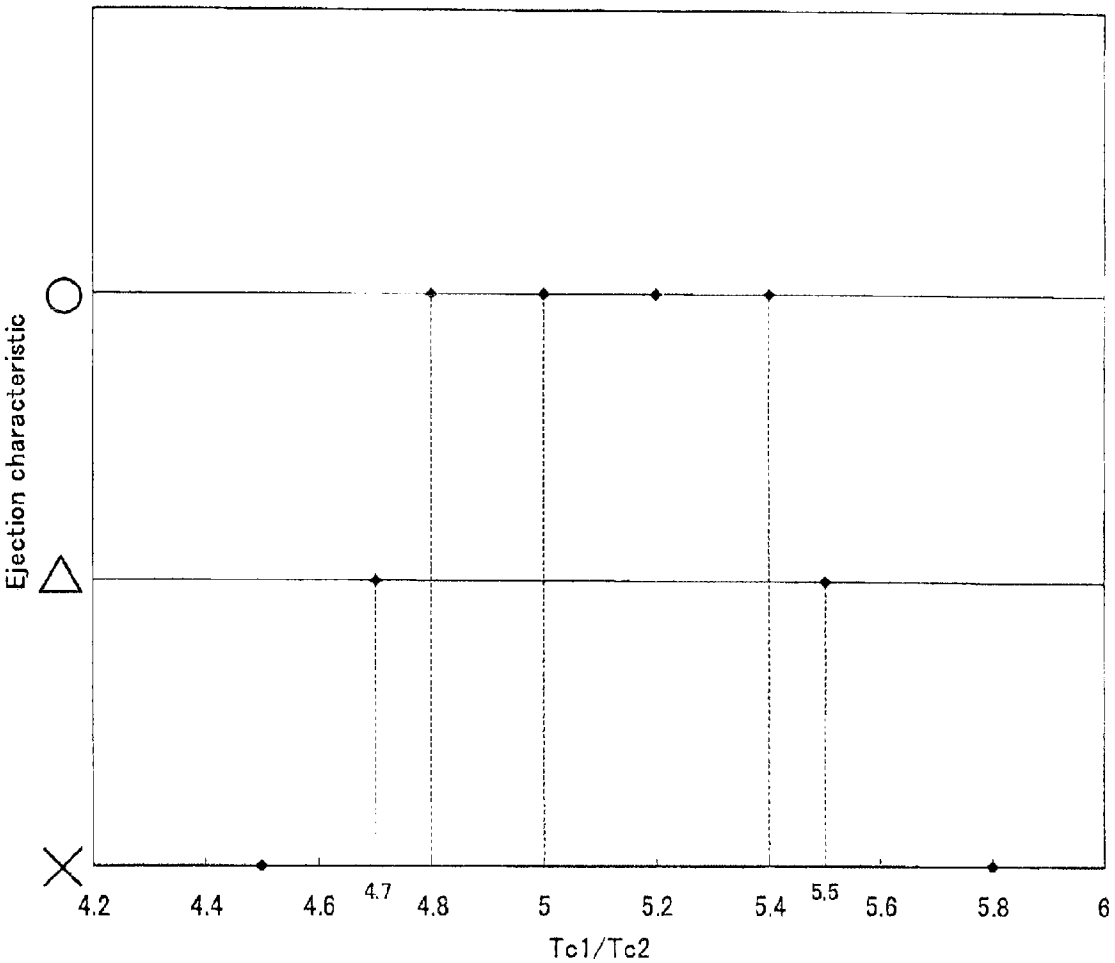
FIG. 18 is a graph showing relations of the length of the first passage and the thickness of the pressure chamber of the individual liquid passage shown in FIGS. 10A to 10D, to Tc1/Tc2, and evaluation of an ejection characteristic of liquid ejected from the liquid ejection head including therein the individual liquid passage, corresponding to each value of Tc1/Tc2.

FIG. 18 shows the results of Table 8. In FIG. 18, the axis of abscissas represents Tc1/Tc2, the axis of ordinate represents the evaluation of the ejection characteristic. FIG. 18 shows that a range that Tc1/Tc2 is substantially not less than 4.7 and not more than 5.5 brings about no practical problem, and a range that Tc1/Tc2 is substantially not less than 4.8 and not more than 5.4 brings about the better ejection characteristic. FIG. 18 also shows that a range that Tc1/Tc2 is substantially not less than 5.0 and not more than 5.5 brings about no practical problem, and a range that Tc1/Tc2 is substantially not less than 5.0 and not more than 5.4 brings about the better ejection characteristic.

From the results of the above-described analyses, each inkjet head 2 of the above-described embodiment is constructed so that Tc1 and Tc2 satisfy a condition that Tc1/Tc2 is substantially not less than 4.7 and not more than 5.5. Thereby, even in the case of an inkjet head in which a short-period proper oscillation is generated, relatively good ejection characteristics can be ensured by ejecting liquid in accordance with a peak of the short-period proper oscillation.

Such ejection characteristics are realized for the following reason. That is, the timing for ejecting liquid droplets can be set on the basis of the short-period proper oscillation. This realizes a head high in responsibility. In addition, in comparison with a case wherein a liquid droplet by the long-period proper oscillation is precedent as a conventional manner, the ejection velocities and amount of liquid droplets are hard to vary. This is for the following reason. In the case of the long-period proper oscillation, the compliance of the actuator is in parallel with the compliance of any other portion of the individual liquid passage. In this case, variation in the compliance from actuator to actuator directly brings about a shift of the peak of the ejection velocity. When the liquid ejection head is equally driven to eject, the ejection velocities vary widely. Contrastingly, because the short-period proper oscillation is the oscillation of a system in which the actuator and, for example, the first passage, are connected in series, variation of actuators is hard to appear directly in the oscillation period.

In each piezoelectric actuator 50 of the above-described embodiment, each individual electrode 35 and the common electrode 34 sandwich the piezoelectric layer 41. Between the common electrode 34 and each pressure chamber 10, the piezoelectric layers 42 to 44 that function as an oscillating plate spread over the pressure chamber 10. When a difference in potential is generated between the common electrode 34 and the individual electrode 35, the piezoelectric layers 41 to 44 are deformed as one body to change the volume of the pressure chamber 10. In the inkjet head 2 thus constructed, when the compliance of the piezoelectric layers 41 to 44 is high, a residual oscillation is apt to be generated and a short-period proper oscillation is easy to be induced. In the present invention, such a short-period proper oscillation is allowed to be generated. In the present invention, by limiting to a predetermined range the relation between the period of the long-period proper oscillation and the period of the short-period proper oscillation, high responsibility is ensured. In addition, by using the short-period proper oscillation, relatively good ejection characteristics are ensured. Thus, the present invention is suitably applied to the above construction of the inkjet head 2.

The nozzles 8 are open at the lower face of the inkjet head 2. The face at which the nozzles 8 are open and the pressure chambers 10 sandwich the sub manifold channels 5*a* perpendicularly to the layered structure of the passage unit 4. This structure causes each descender 33 to be long. Therefore, the volume of the descender 33 is apt to be large, and a short-period proper oscillation is easy to be induced. Thus, the present invention is also suitably applied to this structure.

Next, the inventors of the present invention carried out the following measurements for specifying a proper driving method of the inkjet head 2. First, ink was ejected from the inkjet head 2 with variously changing the value of To. The ejection velocity of ink ejected from the inkjet head 2 was then measured. Such a measurement was repeated with variously changing the values of Tr and Tf. The below Table 9 shows results of the measurements. The measurements of Table 9 were performed under the condition that Tr and Tf satisfy a condition of Tr=Tf.

The measurements of Table 9 were performed with respect to an inkjet head 2 in which the thickness of each pressure chamber 10 is 100 micrometers; the (sectional thickness×width×length) of each restricted passage is (20 micrometers×40 micrometers×300 micrometers); and the (length×mean diameter) of each descender 33 is (830 micrometers×190 micrometers).

TABLE 9

| | | Tr/Tc2 (=Tf/Tc2) | | | | |
|---|---|---|---|---|---|---|
| | | 0.25 | 0.33 | 0.80 | 1.00 | 1.10 |
| To/Tc2 | 2.00 | 7.9 | 7.6 | 6.4 | 5.7 | 4.3 |
| | 2.16 | 8.8 | 8.5 | 7.6 | 7.2 | 5.2 |
| | 2.32 | 9.6 | 9.0 | 8.3 | 8.0 | 6.3 |
| | 2.48 | 9.0 | 9.2 | 8.6 | 8.4 | 7.2 |
| | 2.64 | 8.6 | 8.9 | 8.7 | 8.5 | 7.8 |
| | 2.80 | 8.7 | 7.8 | 7.9 | 8.2 | 8.0 |
| | 2.96 | 7.2 | 6.8 | 6.9 | 7.6 | 7.9 |
| | 3.12 | 6.6 | 6.6 | 6.5 | 6.5 | 7.4 |
| | 3.28 | 6.1 | 5.6 | 5.9 | 5.9 | 6.2 |
| | 3.44 | 4.6 | 4.8 | 5.1 | 5.1 | 5.0 |
| | 3.60 | 3.5 | 3.7 | 4.0 | 4.0 | 3.7 |

Figure 19:
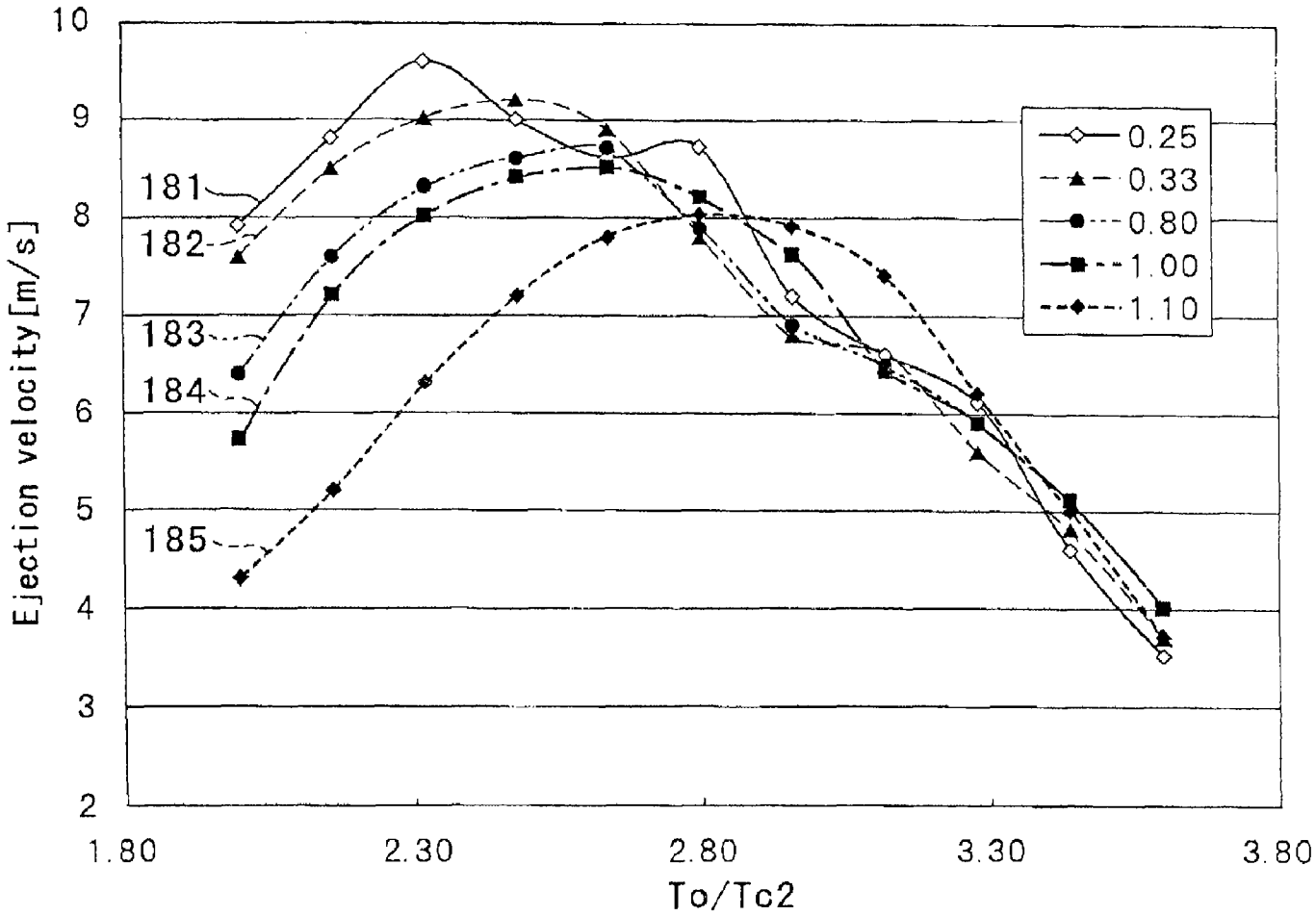
FIG. 19 is a graph showing an ejection characteristic of liquid ejection heads within a range of the present invention shown in FIG. 18, when liquid is ejected with changing a driving condition.

FIG. 19 is a graph showing the results of Table 9. In FIG. 19, curved lines 181 to 185 represent the ink ejection velocities to To/Tc2 when the values of Tr/Tc2 are 0.25, 0.33, 0.80, 1.00, and 1.10, respectively. Any of the curved lines 181 to 185 is generally convex upward. While only a peak of the long-period proper oscillation appears on the curved line 185, a peak of the short-period proper oscillation appears on each of the curved lines 181 to 184 in addition to a peak of the long-period proper oscillation.

As shown in FIG. 19, no peak of the short-period proper oscillation appears on the curved line 185, and the peak of the ejection velocity on the curved line 185 is lower than the peaks of the ejection velocity appearing on the other curved lines. That is, by the driving conditions that cause the ejection characteristics as of the curved line 185 to appear, the short-period proper oscillation is hard to be induced, and the ejection velocity decreases. On the other hand, the peak of the short-period proper oscillation remarkably appears on the curved line 181 in comparison with the other curved lines. By the driving conditions that cause the ejection characteristics as of the curved line 181 to appear, liquid can not stably be ejected because the short-period proper oscillation is too intensive. Thus, the driving conditions of the inkjet head 2 that can efficiently and stably ejects ink, preferably falls within a range that either of Tr/Tc2 and Tf/Tc2 is substantially not less than 0.3 and not more than 1.0, except the ranges in which the ejection characteristics as of the curved lines 181 and 185 appear.

Figure 20:
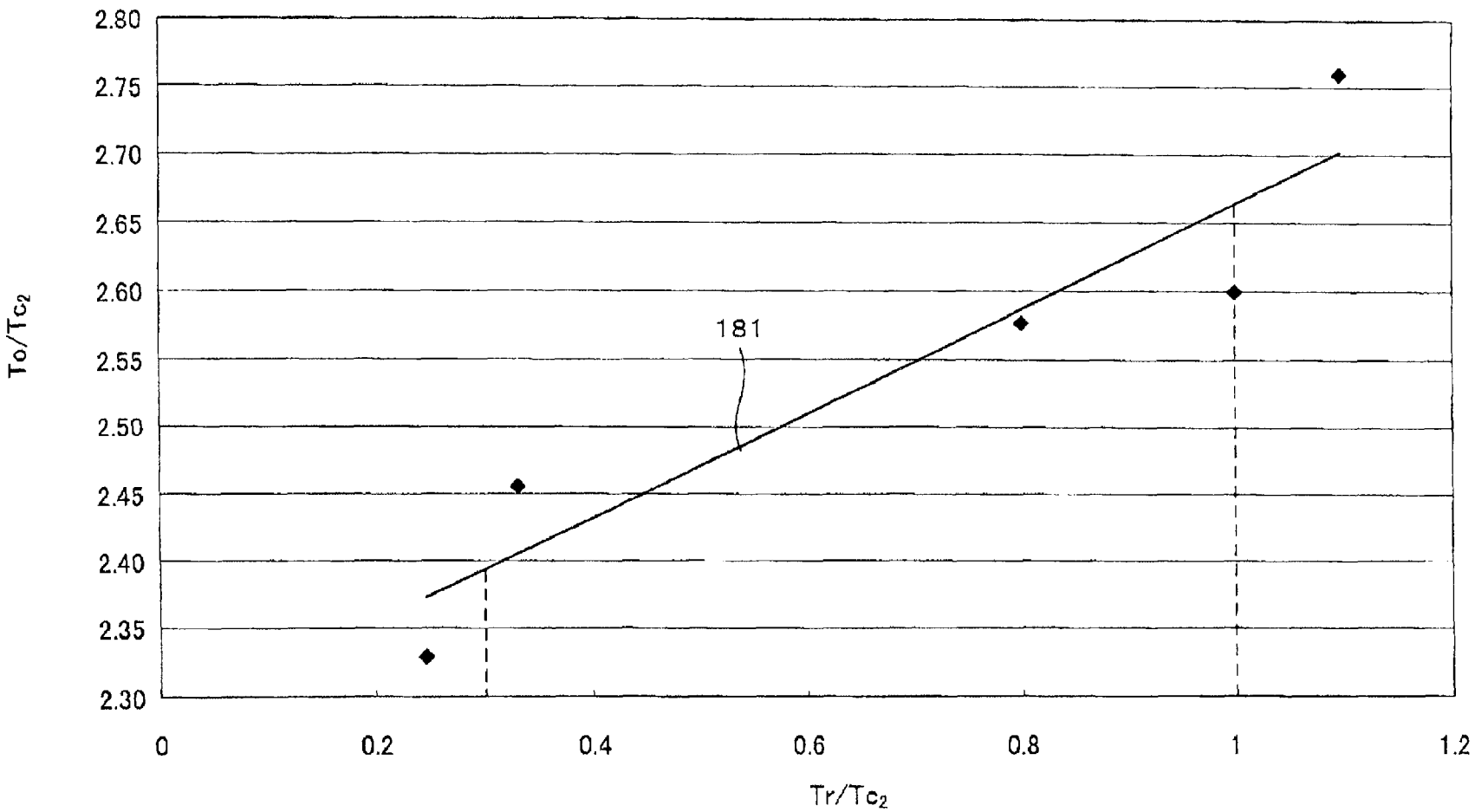
FIG. 20 is a graph obtained by plotting points at which the ejection velocity takes a peak on each curved line of FIG. 19.

The below Table 10 shows the values of To/Tc2 at which the peaks of the ink ejection velocity appear on the respective curved lines 181 to 185 of FIG. 19. The second to sixth rows of the second column of Table 10 show the values of To/Tc2 at which the peaks appear on the respective curved lines 181 to 185. FIG. 20 shows by points the results of Table 10. As shown in FIG. 20, the values of To/Tc2 at which the peaks appear are arranged substantially along a straight line 186 to Tr/Tc2. The straight line 186 shows that the range of To/Tc2 corresponding to the above-described range that either of Tr/Tc2 and Tf/Tc2 is not less than 0.3 and not more than 1.0, is about 2.40 to about 2.65.

TABLE 10

| Tr/Tc2 | To/Tc2 at which the peak appears |
|---|---|
| 0.25 | 2.33 |
| 0.33 | 2.46 |
| 0.8 | 2.58 |

TABLE 10-continued

| Tr/Tc2 | To/Tc2 at which the peak appears |
|---|---|
| 1 | 2.60 |
| 1.1 | 2.76 |

From the above-described analysis, it was found that proper ranges for driving the inkjet head 2 are a range that either of Tr/Tc2 and Tf/Tc2 is not less than 0.3 and not more than 1.0, and a range that To/Tc2 is substantially 2.40 to 2.65.

As will be understood from the above-described analyses, the problems discussed in the present invention are caused by the inertances and the compliances of the liquid passage and the actuator formed in the apparatus. Therefore, the problems do not particularly depend on the specific structure of the liquid passage and the kind of the actuator. For example, differently from the piezoelectric actuator 50, a piezoelectric actuator to be driven by a number of piezoelectric layers, or an actuator adopting a system other than the piezoelectric system, may be used. Further, a liquid passage different in structure from the liquid passage as shown in FIG. 4 may be used. Even in the case of such a liquid ejection head, if the liquid ejection head satisfies the conditions supposed in the above-described analyses, the present invention can be applied.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection head comprising:

a passage unit comprising a nozzle, which ejects liquid, a common liquid chamber, and an individual liquid passage, the individual liquid passage comprising a first passage, which has one end connected to the nozzle, a pressure chamber, which has one end connected to the other end of the first passage, a second passage, which has one end connected to the other end of the pressure chamber, and a restricted passage, which has one end connected to the other end of the second passage and the other end of which is connected to the common liquid chamber, the restricted passage being smaller than the second passage in the area of the passage(s) perpendicular to the direction of the flow of the liquid; and an actuator that can selectively take a first state in which the volume of the pressure chamber is V1 and a second state in which the volume of the pressure chamber is V2 larger than V1, the actuator changing from the first state into the second state and then returning to the first state to eject the liquid from the nozzle, Tc1 and Tc2 defined by the following Expressions 1 and 2 satisfying a condition that Tc1/Tc2 is substantially not less than 4.7 and not more than 5.5:

$$T_{C1} = 2\pi\sqrt{\left(\frac{M_n' \times M_r'}{M_n' + M_r'}\right) \times (C_a + C_c + C_d + C_s)} \quad \text{[Expression 1]}$$

$$T_{C2} = 2\pi\sqrt{M_{C2} \times C_{C2}} \quad \text{[Expression 2]}$$

where M'n, M'r, Mc2, and Cc2 are defined by the following Expressions 3 to 6, respectively:

$$M_n' = M_n + M_c/2 \quad \text{[Expression 3]}$$

$$M_r' = M_r + M_c/2 \quad \text{[Expression 4]}$$

$$M_{C2} = \frac{M_d \times (M_c \times M_s)}{M_d + M_c + M_s} + M_a \quad \text{[Expression 5]}$$

$$C_{C2} = \frac{C_d \times C_a}{C_d \times C_a} \quad \text{[Expression 6]}$$

where Md, Ms, Ma, Mn, Mr, and Mc represent the inertances of the first passage, the second passage, the actuator, the nozzle, the restricted passage, and the pressure chamber, respectively; and Ca, Cc, Cd, and Cs represent the compliances of the actuator, the pressure chamber, the first passage, and the second passage, respectively.

2. The head according to claim 1, wherein Tc1 and Tc2 satisfy a condition that Tc1/Tc2 is substantially not less than 4.8 and not more than 5.4.

3. The head according to claim 1, wherein Tc1 and Tc2 satisfy a condition that Tc1/Tc2 is substantially not less than 5.0 and not more than 5.5.

4. The head according to claim 2, wherein Tc1 and Tc2 satisfy a condition that Tc1/Tc2 is substantially not less than 5.0 and not more than 5.4.

5. The head according to claim 1, wherein the actuator comprises:

a piezoelectric layer;

an oscillating plate disposed between the piezoelectric layer and the pressure chamber so as to spread over the pressure chamber; and a driving electrode pair constituted by two electrodes sandwiching a region of the piezoelectric layer opposed to the pressure chamber, and the piezoelectric layer and the oscillating plate bend as one body to be convex in one of the direction toward the pressure chamber and the direction of getting away from the pressure chamber and the actuator takes one of the first and second states when a first potential difference is generated between the electrodes, and the actuator takes the other of the first and second states when a second potential difference different from the first potential difference is generated between the electrodes.

6. The head according to claim 1, wherein the passage unit has an ejection face at which the nozzle is open, and the common liquid chamber is disposed between the ejection face and the pressure chamber.

7. The head according to claim 1, further comprising a driver which drives the actuator to change from the first state to the second state and then return to the first state, so that, when a time period from the start of the actuator changing from the first state to the start of the actuator taking the second state is Tf and a time period from the start of the actuator changing from the second state to the start of the actuator changing from the second state to the start of the actuator taking the first state is Tr, a condition that either Tr/Tc2 or Tf/Tc2 is not substantially less than 0.3 and is not substantially more than 1.0 is satisfied.

8. The head according to claim 7, wherein:

the driver drives the actuator to change from the first state to the second state and then return to the first state, so that the length of a time period from the start of the actuator changing from the first state into the second state to the start of the actuator changing from the second state into the first state is in a range of substantially 2.40 to 2.65 times the length of Tc2.

* * * * *